US012331982B2

(12) United States Patent
Yun et al.

(10) Patent No.: US 12,331,982 B2
(45) Date of Patent: Jun. 17, 2025

(54) METHOD FOR CONTROLLING REFRIGERATOR

(71) Applicant: LG ELECTRONICS INC., Seoul (KR)

(72) Inventors: Seokjun Yun, Seoul (KR); Hyoungkeun Lim, Seoul (KR); Junghun Lee, Seoul (KR); Hoyoun Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 411 days.

(21) Appl. No.: 17/433,958

(22) PCT Filed: Feb. 13, 2020

(86) PCT No.: PCT/KR2020/002073
§ 371 (c)(1),
(2) Date: Aug. 25, 2021

(87) PCT Pub. No.: WO2020/175827
PCT Pub. Date: Sep. 3, 2020

(65) Prior Publication Data

US 2022/0170685 A1 Jun. 2, 2022

(30) Foreign Application Priority Data

Feb. 28, 2019 (KR) ..... 10-2019-0024247

(51) Int. Cl.
*F25D 29/00* (2006.01)
*F25D 11/02* (2006.01)
*F25D 17/06* (2006.01)

(52) U.S. Cl.
CPC ..... *F25D 11/025* (2013.01); *F25D 11/022* (2013.01); *F25D 17/062* (2013.01);
(Continued)

(58) Field of Classification Search
CPC ..... F25D 17/06; F25D 17/062; F25D 17/065; F25D 11/025; F25D 11/022; F25D 11/02;
(Continued)

(56) References Cited

U.S. PATENT DOCUMENTS 10,808,983 B2 10/2020 Oh et al.
2007/0137226 A1* 6/2007 Kim ..... F25D 11/022 62/179
(Continued)

FOREIGN PATENT DOCUMENTS

EP 2787308 A2 * 10/2014 ..... F25D 11/022
EP 3136025 A1 * 3/2017 ..... F24F 11/74
(Continued)

OTHER PUBLICATIONS

WO-2013172027-A1 English Translation (Year: 2013).*
KR-101821289-B1 English Translation (Year: 2018).*
WO-2016129907-A1 English Translation (Year: 2016).*

*Primary Examiner* — David J Teitelbaum
*Assistant Examiner* — Devon Moore
(74) *Attorney, Agent, or Firm* — Bryan Cave Leighton Paisner LLP

(57) ABSTRACT

A method for controlling a refrigerator according to an embodiment of the present invention is characterized in that, when the temperature of a freezing chamber is in a satisfactory temperature range, and a deep-freezing chamber mode is turned on such that a deep-freezing chamber cooling operation is being performed, the refrigerator is controlled to perform a cold air sagging prevention operation in which a fan of the freezing chamber repeatedly starts and stops at regular intervals.

20 Claims, 8 Drawing Sheets

(52) U.S. Cl.
CPC ..... *F25D 29/00* (2013.01); *F25D 2317/061* (2013.01); *F25D 2600/02* (2013.01); *F25D 2600/06* (2013.01); *F25D 2700/02* (2013.01); *F25D 2700/122* (2013.01)

(58) Field of Classification Search
CPC ..... F25D 2317/061; F25D 2600/02; F25D 2600/06; F25D 2700/02; F25D 2700/122; F25B 5/02
See application file for complete search history.

(56) References Cited

U.S. PATENT DOCUMENTS

| | | | | |
|---|---|---|---|---|
| 2010/0125365 | A1 | 5/2010 | Ahn et al. | |
| 2010/0131107 | A1 | 5/2010 | Eom et al. | |
| 2014/0290303 | A1* | 10/2014 | Shin | F25D 17/065 62/419 |
| 2015/0121925 | A1* | 5/2015 | Park | F25D 17/065 62/186 |
| 2017/0343269 | A1 | 11/2017 | Kim et al. | |
| 2018/0347871 | A1 | 12/2018 | Park et al. | |

FOREIGN PATENT DOCUMENTS

| | | | | |
|---|---|---|---|---|
| JP | 2000-199672 | A | 7/2000 | |
| KR | 10-0229488 | B1 | 1/2000 | |
| KR | 10-2000-0028515 | A | 5/2000 | |
| KR | 1020020045812 | A | 6/2002 | |
| KR | 10-2008-0088848 | A | 10/2008 | |
| KR | 10-2010-0056127 | A | 5/2010 | |
| KR | 10-2017-0133840 | A | 12/2017 | |
| KR | 10-1821290 | B1 | 1/2018 | |
| KR | 101821289 | B1 * | 1/2018 | F25D 19/006 |
| KR | 10-2018-0131752 | A | 12/2018 | |
| WO | WO-2013172027 | A1 * | 11/2013 | F25D 17/062 |
| WO | WO-2016129907 | A1 * | 8/2016 | F25B 21/02 |

* cited by examiner (a)

(b)

(c)

METHOD FOR CONTROLLING REFRIGERATOR

This application is a National Stage Application of International Application No. PCT/KR2020/002073, filed on Feb. 13, 2020, which claims the benefit of and priority to Korean Application No. 10-2019-0024247, filed on Feb. 28, 2019, which are hereby incorporated by reference in their entirety for all purposes as if fully set forth herein.

TECHNICAL FIELD

The present invention relates to a method for controlling a refrigerator.

BACKGROUND ART

In general, a refrigerator is a home appliance for storing food at a low temperature, and includes a refrigerating compartment for storing food in a refrigerated state in a range of 3° C. and a freezing compartment for storing food in a frozen state in a range of −20° C.

However, when food such as meat or seafood is stored in the frozen state in the existing freezing compartment, moisture in cells of the meat or seafood are escaped out of the cells in the process of freezing the food at the temperature of −20° C., and thus, the cells are destroyed, and taste of the food is changed during an unfreezing process.

However, if a temperature condition of the storage compartment is set to a cryogenic state that is significantly lower than the current temperature of the freezing temperature. Thus, when the food quickly passes through a freezing point temperature range while the food is changed in the frozen state, the destruction of the cells may be minimized, and as a result, even after the unfreezing, the meat quality and the taste of the food may return to close to the state before the freezing. The cryogenic temperature may be understood to mean a temperature in a range of −45° C. to −50° C.

For this reason, in recent years, the demand for a refrigerator equipped with a deep freezing compartment that is maintained at a temperature lower than a temperature of the freezing compartment is increasing.

In order to satisfy the demand for the deep freezing compartment, there is a limit to the cooling using an existing refrigerant. Thus, an attempt is made to lower the temperature of the deep freezing compartment to a cryogenic temperature by using a thermoelectric module (TEM).

Korean Patent Publication No. 2018-0131752 (Dec. 13, 2018) that is the prior art discloses a refrigerator having a deep freezing compartment using a thermoelectric module.

According to the prior art, an evaporator provided as a refrigerant pipe, through which a refrigerant passing through an expansion valve flows, is attached to a heat generation surface of the thermoelectric module so that heat absorbed into a heat absorption surface of the thermoelectric module and then transferred to a heat generation surface is released to the evaporator.

The thermoelectric module has a characteristic that a semiconductor is disposed between the heat absorption surface made of a ceramic material and the heat generation surface, and when power is applied, one surface acts as the heat absorption surface, and the other surface acts as the heat generation surface.

The heat absorption surface of the thermoelectric module is exposed to the deep freezing compartment to lower the temperature of the deep freezing compartment, and the heat generation surface is attached to the evaporator to rapidly dissipate heat to the outside.

As disclosed in the prior art below, in a refrigerant circulation system in which the evaporator attached to the heat generation surface of the thermoelectric module and the freezing compartment evaporator are connected to each other in series, the temperature of the freezing compartment is lowered below the set temperature and is in a satisfactory state, and when the deep freezing compartment is in an unsatisfactory state, a low-temperature refrigerant flows to the freezing compartment evaporator for cooling the deep freezing compartment even if the freezing compartment does not operate.

In other words, while the thermoelectric module is driven to cool the deep freezing compartment, the refrigerant valve of the freezing compartment is opened to allow the refrigerant to flow along a heat sink and the freezing compartment evaporator.

In this case, a freezing evaporation compartment in which the freezing compartment evaporator is accommodated is maintained at a low temperature, and the cold air of the freezing evaporation compartment may flow back along a cold air collection passage connecting the freezing compartment to the freezing evaporation compartment and then be introduced into the freezing compartment.

Particularly, since the cold air collection passage for allowing the cold air to return from the freezing compartment to the freezing evaporation compartment is formed in a bottom of a rear surface of the freezing compartment, the cold air flows to the bottom of the freezing compartment through the cold air collection passage.

As a result, temperature non-uniformity between the upper and lower sides of the freezing compartment occurs, and a density of the cold air increases as the freezing compartment is overcooled, resulting in a phenomenon in which the cold air sags to the floor. Particularly, in the autumn or winter in which the room temperature is low, since an amount of heat load contained in the indoor air is introduced into the freezing compartment through heat conduction is small, an increase in load of the freezing compartment is not large compared to that in summer. Then, an operation period of the freezing compartment becomes longer, and an operation frequency of the freezing compartment fan is reduced.

When the rotation speed or operation frequency of the freezing compartment fan is reduced, the sagging of the cold air in the freezing compartment is further aggravated, resulting in a severe temperature deviation between an upper space and a lower space of the freezing compartment.

However, since the prior art does not disclose any structure or control method capable of preventing or minimizing the sagging phenomenon of the cold air in the freezing compartment, there is a disadvantage in that the above problem is not solved.

DISCLOSURE OF THE INVENTION

Technical Problem

The present disclosure has been proposed to improve the above-described limitations.

Technical Solution

In a method for controlling a refrigerator according to an embodiment of the present invention for achieving the above object, when a temperature of a freezing compartment is in a satisfactory temperature range, and a deep freezing compartment mode is turned on to perform a deep freezing compartment cooling operation, the refrigerator is controlled to perform a cold air sagging prevention operation in which a freezing compartment fan is repeatedly driven and stopped with a predetermined period.

Advantageous Effects

According to the method for controlling the refrigerator according to the embodiment of the present invention, which has the configuration as described above, the following effects are obtained.

In detail, the effect of preventing or minimizing the sagging of the cold air that may occur in the refrigerator in which the freezing compartment evaporator and the heat sink serving as the heat sink constituting the thermoelectric module are connected to each other in series, and the deep freezing compartment is disposed inside the freezing compartment.

In more detail, in the environment in which the temperature of the deep freezing compartment is in the unsatisfactory temperature region, and the temperature of the freezing compartment is in the satisfactory temperature region, and also, in the environment in which the room temperature of the space in which the refrigerator is installed is within the low temperature range, the freezing compartment fan is alternately driven and stopped with the predetermined period so that the cold air within the freezing compartment is forcibly circulated to prevent or minimize the occurrence of the sagging of the cold air within the freezing compartment.

MODE FOR CARRYING OUT THE INVENTION

Figure 1:
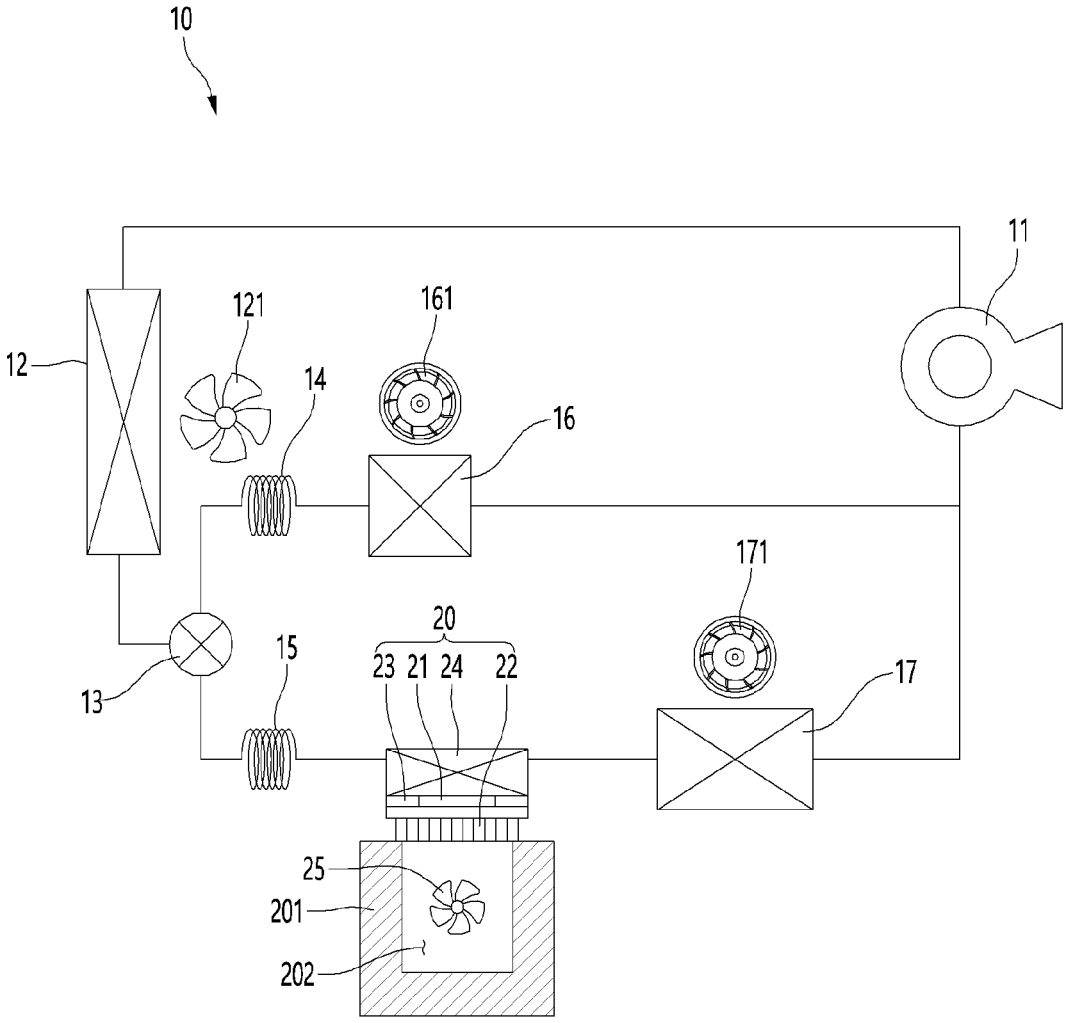
FIG. 1 is a view illustrating a refrigerant circulation system of a refrigerator to which a control method is applied according to an embodiment of the present invention.

Hereinafter, a method for controlling a refrigerator according to an embodiment of the present invention will be described in detail with reference to the accompanying drawings.

In the present invention, a storage compartment that is cooled by a first cooling device and controlled to a predetermined temperature may be defined as a first storage compartment.

In addition, a storage compartment that is cooled by a second cooling device and is controlled to a temperature lower than that of the first storage compartment may be defined as a second storage compartment.

In addition, a storage compartment that is cooled by the third cooling device and is controlled to a temperature lower than that of the second storage compartment may be defined as a third storage compartment.

The first cooling device for cooling the first storage compartment may include at least one of a first evaporator or a first thermoelectric module including a thermoelectric element. The first evaporator may include a refrigerating compartment evaporator to be described later.

The second cooling device for cooling the second storage compartment may include at least one of a second evaporator or a second thermoelectric module including a thermoelectric element. The second evaporator may include a freezing compartment evaporator to be described later.

The third cooling device for cooling the third storage compartment may include at least one of a third evaporator or a third thermoelectric module including a thermoelectric element.

In the embodiments in which the thermoelectric module is used as a cooling means in the present specification, it may be applied by replacing the thermoelectric module with an evaporator, for example, as follows.

(1) "Cold sink of thermoelectric module", "heat absorption surface of thermoelectric module" or "heat absorption side of thermoelectric module" may be interpreted as "evaporator or one side of the evaporator".

(2) "Heat absorption side of thermoelectric module" may be interpreted as the same meaning as "cold sink of thermoelectric module" or "heat absorption side of thermoelectric module".

(3) An electronic controller (processor) "applies or cuts off a constant voltage to the thermoelectric module" may be interpreted as the same meaning as being controlled to "supply or block a refrigerant to the evaporator", "control a switching valve to be opened or closed", or "control a compressor to be turned on or off".

(4) A controller "controls the constant voltage applied to the thermoelectric module to increase or decrease" may be interpreted as the same meaning as "controlling an amount or flow rate of the refrigerant flowing in the evaporator to increase or decrease", "controlling allowing an opening degree of the switching valve to increase or decrease", or "controlling an output of the compressor to increase or decrease".

(5) A controller "controls a reverse voltage applied to the thermoelectric module to increase or decrease" is interpreted as the same meaning as "controlling a voltage applied to the defrost heater adjacent to the evaporator to increase or decrease".

In the present specification, "storage compartment cooled by the thermoelectric module" is defined as a storage compartment A, and "fan located adjacent to the thermoelectric module so that air inside the storage compartment A is heat-exchanged with the heat absorption surface of the thermoelectric module" may be defined as "storage compartment fan A".

Also, a storage compartment cooled by a cooling device and constituting the refrigerator together with the storage compartment A may be defined as "storage compartment B".

In addition, a "cooling device chamber" may be defined as a space in which the cooling device is disposed. In a structure in which the fan for blowing cool air generated by the cooling device is added, the cooling device chamber may be defined as including a space in which the fan is accommodated. In addition, in a structure in which a passage for guiding the cold air blown by the fan to the storage compartment or a passage through which defrost water is discharged is added, the cooling device chamber may be defined as including the passages.

In addition, a defrost heater disposed at one side of the cold sink to remove frost or ice generated on or around the cold sink may be defined as a cold sink defrost heater.

In addition, a defrost heater disposed at one side of the heat sink to remove frost or ice generated on or around the heat sink may be defined as a heat sink defrost heater.

In addition, a defrost heater disposed at one side of the cooling device to remove frost or ice generated on or around the cooling device may be defined as a cooling device defrost heater.

In addition, a defrost heater disposed at one side of a wall surface forming the cooling device chamber to remove frost or ice generated on or around the wall surface forming the cooling device chamber may be defined as a cooling device chamber defrost heater.

In addition, a heater disposed at one side of the cold sink may be defined as a cold sink drain heater in order to minimize refreezing or re-implantation in the process of discharging defrost water or water vapor melted in or around the cold sink.

In addition, a heater disposed at one side of the heat sink may be defined as a heat sink drain heater in order to minimize refreezing or re-implantation in the process of discharging defrost water or water vapor melted in or around the heat sink.

In addition, a heater disposed at one side of the cooling device may be defined as a cooling device drain heater in order to minimize refreezing or re-implantation in the process of discharging defrost water or water vapor melted in or around the cooling device.

In addition, in the process of discharging the defrost water or water vapor melted from or around the wall forming the cooling device chamber, a heater disposed at one side of the wall forming the cooling device chamber may be defined as a cooling device chamber drain heater in order to minimize refreezing or re-implantation.

Also, a "cold sink heater" to be described below may be defined as a heater that performs at least one of a function of the cold sink defrost heater or a function of the cold sink drain heater.

In addition, the "heat sink heater" may be defined as a heater that performs at least one of a function of the heat sink defrost heater or a function of the heat sink drain heater.

In addition, the "cooling device heater" may be defined as a heater that performs at least one of a function of the cooling device defrost heater or a function of the cooling device drain heater.

In addition, a "back heater" to be described below may be defined as a heater that performs at least one of a function of the heat sink heater or a function of the cooling device chamber defrost heater. That is, the back heater may be defined as a heater that performs at least one function among the functions of the heat sink defrost heater, the heater sink drain heater, and the cooling device chamber defrost heater.

In the present invention, as an example, the first storage compartment may include a refrigerating compartment that is capable of being controlled to a zero temperature by the first cooling device.

In addition, the second storage compartment may include a freezing compartment that is capable of being controlled to a temperature below zero by the second cooling device.

In addition, the third storage compartment may include a deep freezing compartment that is capable of being maintained at a cryogenic temperature or an ultrafrezing temperature by the third cooling device.

In the present invention, a case in which all of the third to third storage compartments are controlled to a temperature below zero, a case in which all of the first to third storage compartments are controlled to a zero temperature, and a case in which the first and second storage chambers are controlled to the zero temperature, and the third storage chamber is controlled to the temperature below zero are not excluded.

In the present invention, an "operation" of the refrigerator may be defined as including four processes such as a process (I) of determining whether an operation start condition or an operation input condition is satisfied, a process (II) of performing a predetermined operation when the operation input condition is satisfied, a process (III) of determining whether an operation completion condition is satisfied, and a step (IV) of terminating the operation when the operation completion condition is satisfied.

In the present invention, an "operation" for cooling the storage compartment of the refrigerator may be defined by being divided into a general operation and a special operation.

The general operation may be referred to as a cooling operation performed when an internal temperature of the refrigerator naturally increases in a state in which the storage compartment door does not opened, or a load input condition due to food storage does not occur.

In detail, when the temperature of the storage compartment enters an unsatisfactory temperature region (described below in detail with reference to the drawings), and the operation input condition is satisfied, the controller controls the cold air to be supplied from the cooling device of the storage compartment so as to cool the storage compartment.

Specifically, the general operation may include a refrigerating compartment cooling operation, a freezing compartment cooling operation, a deep freezing compartment cooling operation, and the like.

On the other hand, the special operation may mean an operation other than the operations defined as the general operation.

In detail, the special operation may include a defrost operation controlled to supply heat to the cooling device so as to melt the frost or ice deposited on the cooling device after a defrost period of the storage compartment elapses.

In addition, the special operation may further include a load correspondence operation for controlling the cold air to be supplied from the cooling device to the storage compartment so as to remove a heat load penetrated into the storage compartment when a set time elapses from a time when a door of the storage compartment is opened and closed, or when a temperature of the storage compartment rises to a set temperature before the set time elapses.

In detail, the load correspondence operation includes a door load correspondence operation performed to remove a load penetrated into the storage compartment after opening and closing of the storage compartment door, and an initial cold start operation performed to remove a load correspondence operation performed to remove a load inside the storage compartment when power is first applied after installing the refrigerator.

For example, the defrost operation may include at least one of a refrigerator compartment defrost operation, a freezing compartment defrost operation, and a deep freezing compartment defrost operation.

Also, the door load correspondence operation may include at least one of a refrigerator compartment door load correspondence operation, a freezing compartment door load correspondence operation, and a deep freezing compartment load correspondence operation.

Here, the deep freezing compartment load correspondence operation may be interpreted as an operation for removing the deep freezing compartment load, which is performed when at least one condition of the deep freezing compartment door load correspondence input condition performed when the load increases due to the opening of the door of the deep freezing compartment, the initial cold start operation input condition preformed to remove the load within the deep freezing compartment when the deep freezing compartment is switched from an on state to an off state, or the operation input condition after the defrosting that initially stats after the deep freezing compartment defrost operation is completed.

In detail, determining whether the operation input condition corresponding to the load of the deep freezing compartment door is satisfied may include determining whether at least one of a condition in which a predetermined amount of time elapses from at time point at which at least one of the freezing compartment door and the deep freezing compartment door is closed after being opened, or a condition in which a temperature of the deep freezing compartment rises to a set temperature within a predetermined time is satisfied.

In addition, determining whether the initial cold start operation input condition of the deep freezing compartment is satisfied may include determining whether the refrigerator is powered on, and the deep freezing compartment mode is switched from the off state to the on state.

In addition, determining whether the operation input condition is satisfied after the deep freezing compartment defrost may include determining at least one of stopping of the reverse voltage applied to the thermoelectric module for cold sink heater off, back heater off, cold sink defrost, stopping of the constant voltage applied to the thermoelectric module for the heat sink defrost after the reverse voltage is applied for the cold sink defrost, an increase of a temperature of a housing accommodating the heat sink to a set temperature, or terminating of the freezing compartment defrost operation.

Thus, the operation of the storage compartment including at least one of the refrigerating compartment, the freezing compartment, or the deep freezing compartment may be summarized as including the general storage compartment operation and the storage compartment special operation.

When two operations conflict with each other during the operation of the storage compartment described above, the controller may control one operation (operation A) to be performed preferentially and the other operation (operation B) to be paused.

In the present invention, the conflict of the operations may include i) a case in which an input condition of the operation A and an input condition of the operation B are satisfied at the same time to conflict with each other, a case in which the input condition of the operation B is satisfied while the input condition of the operation A is satisfied to perform the operation A to conflict with each other, and a case in which the input condition of operation A is satisfied while the input condition of the operation B is satisfied to perform the operation B to conflict with each other.

When the two operations conflict with each other, the controller determines the performance priority of the conflicting operations to perform a so-called "conflict control algorithm" to be executed in order to control the performance of the corresponding operation.

A case in which the operation A is performed first, and the operation B is stopped will be described as an example.

In detail, in the present invention, the paused operation B may be controlled to follow at least one of the three cases of the following example after the completion of the operation A.

a. Termination of Operation B

When the operation A is completed, the performance of the operation B may be released to terminate the conflict control algorithm and return to the previous operation process.

Here, the "release" does not determine whether the paused operation B is not performed any more, and whether the input condition of the operation B is satisfied. That is, it is seen that the determination information on the input condition of the operation B is initialized.

b. Redetermination of Input Condition of Operation B

When the firstly performed operation A is completed, the controller may return to the process of determining again whether the input condition of the paused operation B is satisfied, and determine whether the operation B restarts.

For example, if the operation B is an operation in which the fan is driven for 10 minutes, and the operation is stopped when 3 minutes elapses after the start of the operation due to the conflict with the operation A, it is determined again whether the input condition of the operation B is satisfied at a time point at which the operation A is completed, and if it is determined to be satisfied, the fan is driven again for 10 minutes.

c. Continuation of Operation B

When the firstly performed operation A is completed, the controller may allow the paused operation B to be continued. Here, "continuation" means not to start over from the beginning, but to continue the paused operation.

For example, if the operation B is an operation in which the fan is driven for 10 minutes, and the operation is paused after 3 minutes elapses after the start of the operation due to the conflict with operation A, the compressor is further driven for the remaining time of 7 minutes immediately after the operation A is completed.

In the present invention, the priority of the operations may be determined as follows.

First, when the general operation and the special operation conflict with each other, it is possible to control the special operation to be performed preferentially.

Second, when the conflict between the general operation occurs, the priority of the operations may be determined as follows.

I. When the refrigerating compartment cooling operation and the freezing compartment cooling operation conflict with each other, the refrigerating compartment cooling operation may be performed preferentially.

II. When the refrigerating compartment (or freezing compartment) cooling operation and the deep freezing compartment cooling operation conflict with each other, the refrigerating compartment (or freezing compartment) cooling operation may be performed preferentially. Here, in order to prevent the deep freezing compartment temperature from rising excessively, cooling capacity having a level lower than that of maximum cooling capacity of the deep freezing compartment cooling device may be supplied from the deep freezing compartment cooling device to the deep freezing compartment.

The cooling capacity may mean at least one of cooling capacity of the cooling device itself and an airflow amount of the cooling fan disposed adjacent to the cooling device. For example, when the cooling device of the deep freezing compartment is the thermoelectric module, the controller may perform the refrigerating compartment (or freezing compartment) cooling operation with priority when the refrigerating compartment (or freezing compartment) cooling operation and the deep freezing compartment cooling operation conflict with each other. Here, a voltage lower than a maximum voltage that is capable of being applied to the thermoelectric module may be input into the thermoelectric module.

Third, when the conflict between special operation occurs, the priority of the operations may be determined as follows.

I. When a refrigerator compartment door load correspondence operation conflicts with a freezing compartment door load correspondence operation, the controller may control the refrigerator compartment door load correspondence operation to be performed with priority.

II. When the freezing compartment door load correspondence operation conflicts with the deep freezing compartment door load correspondence operation, the controller may control the deep freezing compartment door load correspondence operation to be performed with priority.

III. If the refrigerating compartment operation and the deep freezing compartment door load correspondence operation conflict with each other, the controller may control the refrigerating compartment operation and the deep freezing compartment door load correspondence operation so as to be performed at the same time. Then, when the temperature of the refrigerating compartment reaches a specific temperature a, the controller may control the deep freezing compartment door load correspondence operation so as to be performed alone. When the refrigerator compartment temperature rises again to reach a specific temperature b ($a<b$) while the deep freezing compartment door load correspondence operation is performed independently, the controller may control the refrigerator compartment operation and the deep freezing compartment door load correspondence operation so as to be performed at the same time. Thereafter, an operation switching process between the simultaneous operation of the deep freezing compartment and the refrigerating compartment and the single operation of the deep freezing compartment may be controlled to be repeatedly performed according to the temperature of the refrigerating compartment.

As an extended modified example, when the operation input condition of the deep freezing compartment load correspondence operation is satisfied, the controller may control the operation to be performed in the same manner as when the refrigerator compartment operation and the deep freezing compartment door load correspondence operation conflict with each other.

Hereinafter, as an example, the description is limited to the case in which the first storage compartment is the refrigerating compartment, the second storage compartment is the freezing compartment, and the third storage compartment is the deep freezing compartment.

FIG. 1 is a view illustrating a refrigerant circulation system of a refrigerator according to an embodiment of the present invention.

Referring to FIG. 1, a refrigerant circulation system according to an embodiment of the present invention includes a compressor 11 that compresses a refrigerant into a high-temperature and high-pressure gaseous refrigerant, a condenser 12 that condenses the refrigerant discharged from the compressor 11 into a high-temperature and high-pressure liquid refrigerant, an expansion valve that expands the refrigerant discharged from the condenser 12 into a low-temperature and low-pressure two-phase refrigerant, and an evaporator that evaporates the refrigerant passing through the expansion valve into a low-temperature and low-pressure gaseous refrigerant. The refrigerant discharged from the evaporator flows into the compressor 11. The above components are connected to each other by a refrigerant pipe to constitute a closed circuit.

In detail, the expansion valve may include a refrigerator compartment expansion valve 14 and a freezing compartment expansion valve 15. The refrigerant pipe is divided into two branches at an outlet side of the condenser 12, and the refrigerating compartment expansion valve 14 and the freezing compartment expansion valve 15 are respectively connected to the refrigerant pipe that is divided into the two branches. That is, the refrigerating compartment expansion valve 14 and the freezing compartment expansion valve 15 are connected in parallel at the outlet of the condenser 12.

A switching valve 13 is mounted at a point at which the refrigerant pipe is divided into the two branches at the outlet side of the condenser 12. The refrigerant passing through the condenser 12 may flow through only one of the refrigerating compartment expansion valve 14 and the freezing compartment expansion valve 15 by an operation of adjusting an opening degree of the switching valve 13 or may flow to be divided into both sides.

The switching valve 13 may be a three-way valve, and a flow direction of the refrigerant is determined according to an operation mode. Here, one switching valve such as the three-way valve may be mounted at an outlet of the condenser 12 to control the flow direction of the refrigerant, or alternatively, the switching valves are mounted at inlet sides of a refrigerator compartment expansion valve 14 and a freezing compartment expansion valve 15, respectively.

As a first example of an evaporator arrangement manner, the evaporator may include a refrigerating compartment evaporator 16 connected to an outlet side of the refrigerating compartment expansion valve 14 and a heat sink 24 and a freezing compartment evaporator 17, which are connected in series to an outlet side of the freezing compartment expansion valve 15. The heat sink 24 and the freezing compartment evaporator 17 are connected in series, and the refrigerant passing through the freezing compartment expansion valve passes through the heat sink 24 and then flows into the freezing compartment evaporator 17.

As a second example, the heat sink 24 may be disposed at an outlet side of the freezing compartment evaporator 17 so that the refrigerant passing through the freezing compartment evaporator 17 flows into the heat sink 24.

As a third example, a structure in which the heat sink 24 and the freezing compartment evaporator 17 are connected in parallel at an outlet end of the freezing compartment expansion valve 15 is not excluded.

Although the heat sink 24 is the evaporator, it is provided for the purpose of cooling a heat generation surface of the thermoelectric module to be described later, not for the purpose of heat-exchange with the cold air of the deep freezing compartment.

In each of the three examples described above with respect to the arrangement manner of the evaporator, a complex system of a first refrigerant circulation system, in which the switching valve 13, the refrigerating compartment expansion valve 14, and the refrigerating compartment evaporator 16 are removed, and a second refrigerant circulation system constituted by the refrigerating compartment cooling evaporator, the refrigerating compartment cooling expansion valve, the refrigerating compartment cooling condenser, and a refrigerating compartment cooling compressor is also possible. Here, the condenser constituting the first refrigerant circulation system and the condenser constituting the second refrigerant circulation system may be independently provided, and a complex condenser which is provided as a single body and in which the refrigerant is not mixed may be provided.

The refrigerant circulation system of the refrigerator having the two storage compartments including the deep freezing compartment may be configured only with the first refrigerant circulation system.

Hereinafter, as an example, the description will be limited to a structure in which the heat sink and the freezing compartment evaporator 17 are connected in series.

A condensing fan 121 is mounted adjacent to the condenser 12, a refrigerating compartment fan 161 is mounted adjacent to the refrigerating compartment evaporator 16, and a freezing compartment fan 171 is mounted adjacent to the freezing compartment evaporator 17.

A refrigerating compartment maintained at a refrigerating temperature by cold air generated by the refrigerating compartment evaporator 16, a freezing compartment maintained at a freezing temperature by cold air generated by the freezing compartment evaporator 16, and a deep freezing compartment 202 maintained at a cryogenic or ultrafreezing temperature by a thermoelectric module to be described later are formed inside the refrigerator provided with the refrigerant circulation system according to the embodiment of the present invention. The refrigerating compartment and the freezing compartment may be disposed adjacent to each other in a vertical direction or horizontal direction and are partitioned from each other by a partition wall. The deep freezing compartment may be provided at one side of the inside of the freezing compartment, but the present invention includes the deep freezing compartment provided at one side of the outside of the freezing compartment. In order to block the heat exchange between the cold air of the deep freezing compartment and the cold air of the freezing compartment, the deep freezing compartment 202 may be partitioned from the freezing compartment by a deep freezing case 201 having the high thermal insulation performance.

In addition, the thermoelectric module includes a thermoelectric module 21 having one side through which heat is absorbed and the other side through which heat is released when power is supplied, a cold sink 22 mounted on the heat absorption surface of the thermoelectric module 21, a heat sink mounted on the heat generation surface of the thermoelectric module 21, and an insulator 23 that blocks heat exchange between the cold sink 22 and the heat sink.

Here, the heat sink 24 is an evaporator that is in contact with the heat generation surface of the thermoelectric module 21. That is, the heat transferred to the heat generation surface of the thermoelectric module 21 is heat-exchanged with the refrigerant flowing inside the heat sink 24. The refrigerant flowing along the inside of the heat sink 24 and absorbing heat from the heat generation surface of the thermoelectric module 21 is introduced into the freezing compartment evaporator 17.

In addition, a cooling fan may be provided in front of the cold sink 22, and the cooling fan may be defined as the deep freezing compartment fan 25 because the fan is disposed behind the inside of the deep freezing compartment.

The cold sink 22 is disposed behind the inside of the deep freezing compartment 202 and configured to be exposed to the cold air of the deep freezing compartment 202. Thus, when the deep freezing compartment fan 25 is driven to forcibly circulate cold air in the deep freezing compartment 202, the cold sink 22 absorbs heat through heat-exchange with the cold air in the deep freezing compartment and then is transferred to the heat absorption surface of the thermoelectric module 21. The heat transferred to the heat absorption surface is transferred to the heat generation surface of the thermoelectric module 21.

The heat sink 24 functions to absorb the heat absorbed from the heat absorption surface of the thermoelectric module 21 and transferred to the heat generation surface of the thermoelectric module 21 again to release the heat to the outside of the thermoelectric module 20.

Figure 2:
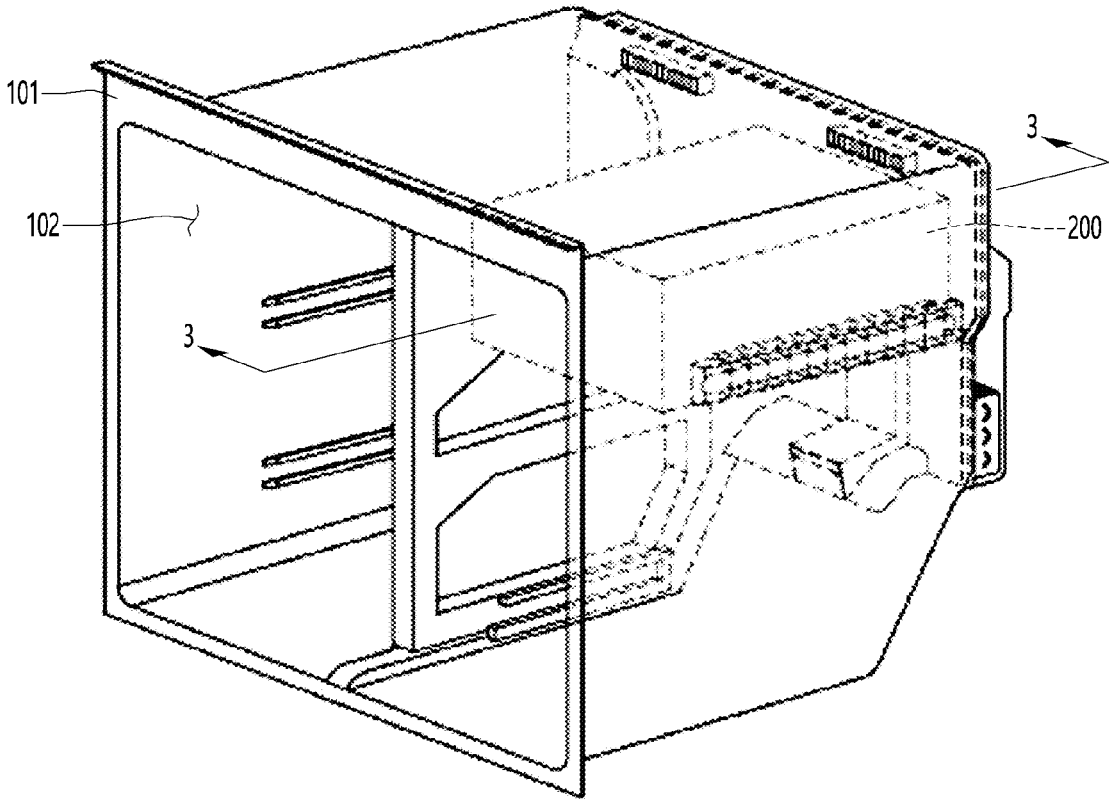
FIG. 2 is a perspective view illustrating structures of a freezing compartment and a deep freezing compartment of the refrigerator according to an embodiment of the present invention.
Figure 3:
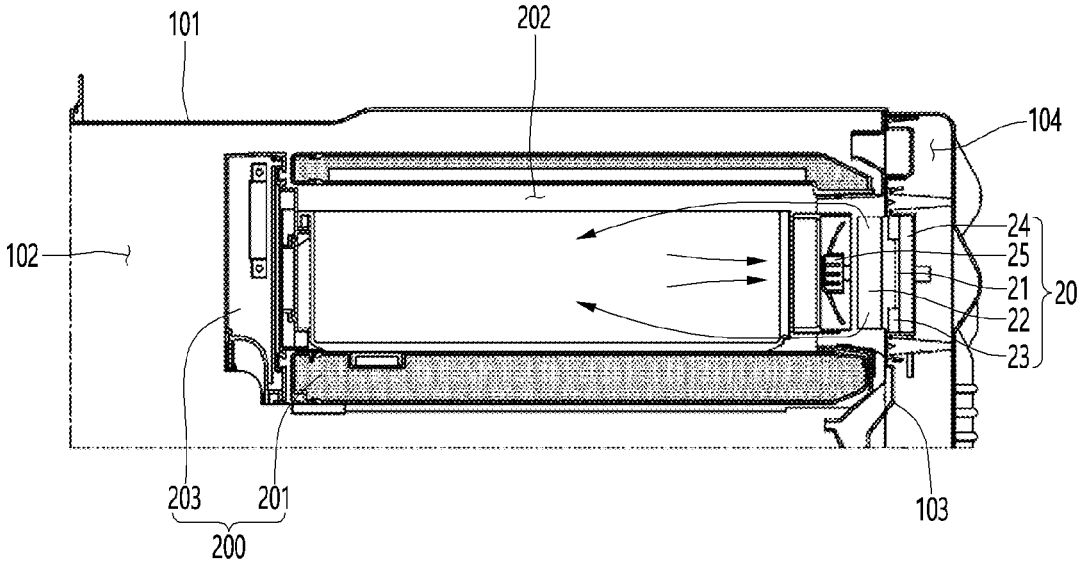
FIG. 3 is a longitudinal cross-sectional view taken along line 3-3 of FIG. 2.

FIG. 2 is a perspective view illustrating structures of the freezing compartment and the deep freezing compartment of the refrigerator according to an embodiment of the present invention, and FIG. 3 is a longitudinal cross-sectional view taken along line 3-3 of FIG. 2.

Referring to FIGS. 2 and 3, the refrigerator according to an embodiment of the present invention includes an inner case 101 defining the freezing compartment 102 and a deep freezing unit 200 mounted at one side of the inside of the freezing compartment 102.

In detail, the inside of the refrigerating compartment is maintained to a temperature of about 3° C., and the inside of the freezing compartment 102 is maintained to a temperature of about −18° C., whereas a temperature inside the deep freezing unit 200, i.e., an internal temperature of the deep freezing compartment 202 has to be maintained to about −50° C. Therefore, in order to maintain the internal temperature of the deep freezing compartment 202 at a cryogenic temperature of −50° C., an additional freezing means such as the thermoelectric module 20 is required in addition to the freezing compartment evaporator.

In more detail, the deep freezing unit 200 includes a deep freezing case 201 that forms a deep freezing compartment 202 therein, a deep freezing compartment drawer 203 slidably inserted into the deep freezing case 201, and a thermoelectric module 20 mounted on a rear surface of the deep freezing case 201.

Instead of applying the deep freezing compartment drawer 203, a structure in which a deep freezing compartment door is connected to one side of the front side of the deep freezing case 201, and the entire inside of the deep freezing compartment 201 is configured as a food storage space is also possible.

In addition, the rear surface of the inner case 101 is stepped backward to form a freezing evaporation compartment 104 in which the freezing compartment evaporator 17 is accommodated. In addition, an inner space of the inner case 101 is divided into the freezing evaporation compartment 104 and the freezing compartment 102 by the partition wall 103. The thermoelectric module 20 is fixedly mounted on a front surface of the partition wall 103, and a portion of the thermoelectric module 20 passes through the deep freezing case 201 and is accommodated in the deep freezing compartment 202.

In detail, the heat sink 24 constituting the thermoelectric module 20 may be an evaporator connected to the freezing compartment expansion valve 15 as described above. A space in which the heat sink 24 is accommodated may be formed in the partition wall 103.

Since the two-phase refrigerant cooled to a temperature of about −18° C. to −20° C. while passing through the freezing compartment expansion valve 15 flows inside the heat sink 24, a surface temperature of the heat sink 24 may be maintained to a temperature of −18° C. to −20° C. Here, it is noted that a temperature and pressure of the refrigerant passing through the freezing compartment expansion valve 15 may vary depending on the freezing compartment temperature condition.

When a rear surface of the thermoelectric module 21 is in contact with a front surface of the heat sink 24, and power is applied to the thermoelectric module 21, the rear surface of the thermoelectric module 21 becomes a heat generation surface.

When the cold sink 22 is in contact with a front surface of the thermoelectric module, and power is applied to the thermoelectric module 21, the front surface of the thermoelectric module 21 becomes a heat absorption surface.

The cold sink 22 may include a heat conduction plate made of an aluminum material and a plurality of heat exchange fins extending from a front surface of the heat conduction plate. Here, the plurality of heat exchange fins extend vertically and are disposed to be spaced apart from each other in a horizontal direction.

Here, when a housing surrounding or accommodating at least a portion of a heat conductor constituted by the heat conduction plate and the heat exchange fin is provided, the cold sink 22 has to be interpreted as a heat transfer member including the housing as well as the heat conductor. This is equally applied to the heat sink 22, and the heat sink 22 has be interpreted not only as the heat conductor constituted by the heat conduction plate and the heat exchange fin, but also as the heat transfer member including the housing when a housing is provided.

The deep freezing compartment fan 25 is disposed in front of the cold sink 22 to forcibly circulate air inside the deep freezing compartment 202.

Hereinafter, efficiency and cooling capacity of the thermoelectric module will be described.

The efficiency of the thermoelectric module 20 may be defined as a coefficient of performance (COP), and an efficiency equation is as follows.

$$COP = \frac{Q_c}{P_e}$$

$Q_c$: Cooling Capacity (ability to absorb heat)

$P_e$: Input Power $$P_e = V \times i$$

In addition, the cooling capacity of the thermoelectric module 20 may be defined as follows.

$$Q_c = \alpha T_c i - \frac{1}{2}\frac{\rho L}{A} i^2 - \frac{kA}{L}(T_h - T_c)$$

<Semiconductor Material Property Coefficient>

α: Seebeck Coefficient [V/K]

ρ: Specific Resistance [Ωm−1]

k: Thermal Conductivity [W/mk]

<Semiconductor Structure Characteristics>

L: Thickness of thermoelectric module: Distance between heat absorption surface and heat generation surface A: Surface of thermoelectric module <System Use Condition> i: Current

V: Voltage

Th: Temperature of heat generation surface of thermoelectric module

Tc: Temperature of heat absorption surface of thermoelectric module

In the above cooling capacity equation, a first item at the right may be defined as a Peltier Effect and may be defined as an amount of heat transferred between both ends of the heat absorption surface and the heat generation surface by a voltage difference. The Peltier effect increases in proportional to supply current as a function of current.

In the formula V=iR, since a semiconductor constituting the thermoelectric module acts as resistance, and the resistance may be regarded as a constant, it may be said that a voltage and current have a proportional relationship. That is, when the voltage applied to the thermoelectric module 21 increases, the current also increases. Accordingly, the Peltier effect may be seen as a current function or as a voltage function.

The cooling capacity may also be seen as a current function or a voltage function. The Peltier effect acts as a positive effect of increasing in cooling capacity. That is, as the supply voltage increases, the Peltier effect increases to increase in cooling capacity.

The second item in the cooling capacity equation is defined as a Joule Effect.

The Joule effect means an effect in which heat is generated when current is applied to a resistor. In other words, since heat is generated when power is supplied to the thermoelectric module, this acts as a negative effect of reducing the cooling capacity. Therefore, when the voltage supplied to the thermoelectric module increases, the Joule effect increases, resulting in lowering of the cooling capacity of the thermoelectric module.

The third item in the cooling capacity equation is defined as a Fourier effect.

The Fourier effect means an effect in which heat is transferred by heat conduction when a temperature difference occurs on both surfaces of the thermoelectric module.

In detail, the thermoelectric module includes a heat absorption surface and a heat generation surface, each of which is provided as a ceramic substrate, and a semiconductor disposed between the heat absorption surface and the heat generation surface. When a voltage is applied to the thermoelectric module, a temperature difference is generated between the heat absorption surface and the heat generation surface. The heat absorbed through the heat absorption surface passes through the semiconductor and is transferred to the heat generation surface. However, when the temperature difference between the heat absorption surface and the heat absorption surface occurs, a phenomenon in which heat flows backward from the heat generation surface to the heat absorption surface by heat conduction occurs, which is referred to as the Fourier effect.

Like the Joule effect, the Fourier effect acts as a negative effect of lowering the cooling capacity. In other words, when the supply current increases, the temperature difference (Th—Tc) between the heat generation surface and the heat absorption surface of the thermoelectric module, i.e., a value ΔT, increases, resulting in lowering of the cooling capacity.

Figure 4:
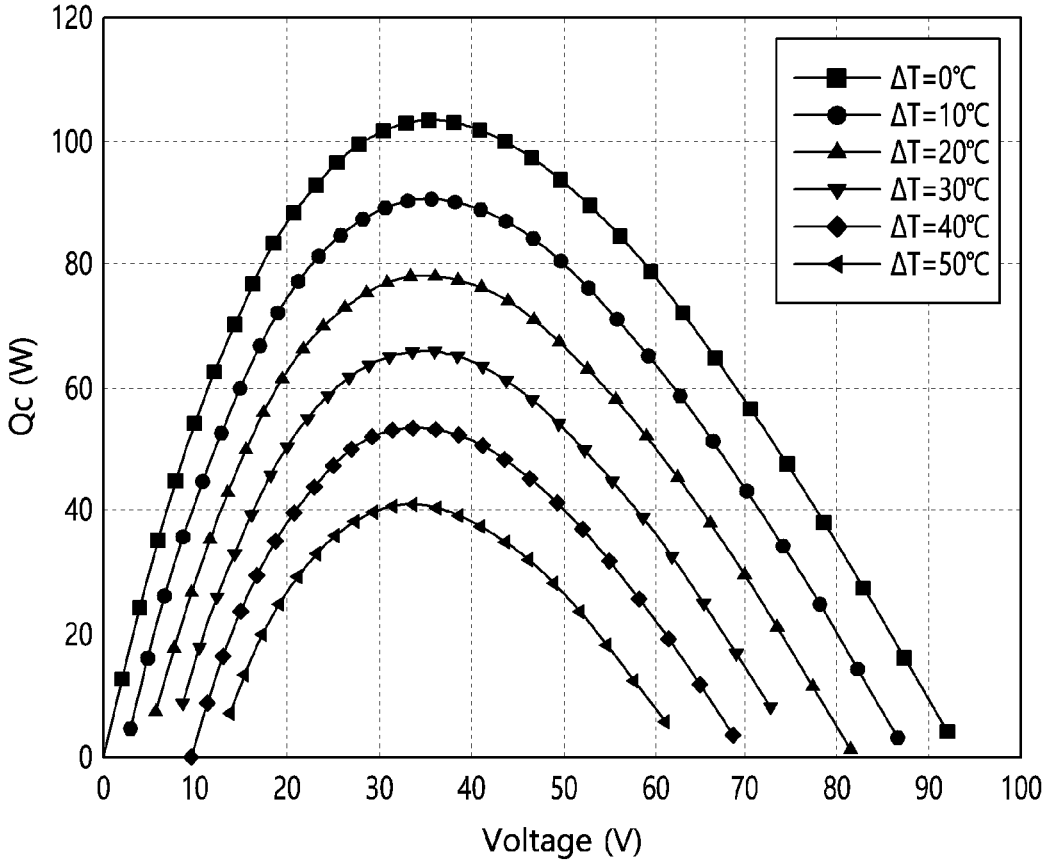
FIG. 4 is a graph illustrating a relationship of cooling capacity with respect to an input voltage and a Fourier effect.

FIG. 4 is a graph illustrating a relationship of cooling capacity with respect to the input voltage and the Fourier effect.

Referring to FIG. 4, the Fourier effect may be defined as a function of the temperature difference between the heat absorption surface and the heat generation surface, that is, a value ΔT.

In detail, when standards of the thermoelectric module are determined, values k, A, and L in the item of the Fourier effect in the above cooling capacity equation become constant values, and thus, the Fourier effect may be seen as a function with the value ΔT as a variable.

Therefore, as the value ΔT increases, the value of the Fourier effect increases, but the Fourier effect acts as a negative effect on the cooling capacity, and thus the cooling capacity decreases.

As shown in the graph of FIG. 4, it is seen that the greater the value ΔT under the constant voltage condition, the less the cooling capacity.

In addition, when the value ΔT is fixed, for example, when ΔT is 30° C., a change in cooling capacity according to a change of the voltage is observed. As the voltage value increases, the cooling capacity increases and has a maximum value at a certain point and then decreases again.

Here, since the voltage and current have a proportional relationship, it should be noted that it is no matter to view the current described in the cooling capacity equation as the voltage and be interpreted in the same manner.

In detail, the cooling capacity increases as the supply voltage (or current) increases, which may be explained by the above cooling capacity equation. First, since the value ΔT is fixed, the value ΔT becomes a constant. Since the ΔT value for each standard of the thermoelectric module is determined, an appropriate standard of the thermoelectric module may be set according to the required value ΔT.

Since the value ΔT is fixed, the Fourier effect may be seen as a constant, and the cooling capacity may be simplified into a function of the Peltier effect, which is seen as a first-order function of the voltage (or current), and the Joule effect, which is seen as a second-order function of the voltage (or current).

As the voltage value gradually increases, an amount of increase in Peltier effect, which is the first-order function of the voltage, is larger than that of increase in Joule effect, which is the second-order function, of voltage, and consequently, the cooling capacity increases. In other words, until the cooling capacity is maximized, the function of the Joule effect is close to a constant, so that the cooling capacity approaches the first-order function of the voltage.

As the voltage further increases, it is seen that a reversal phenomenon, in which a self-heat generation amount due to the Joule effect is greater than a transfer heat amount due to the Peltier effect, occurs, and as a result, the cooling capacity decreases again. This may be more clearly understood from the functional relationship between the Peltier effect, which is the first-order function of the voltage (or current), and the Joule effect, which is the second-order function of the voltage (or current). That is, when the cooling capacity decreases, the cooling capacity is close to the second-order function of the voltage.

In the graph of FIG. 4, it is confirmed that the cooling capacity is maximum when the supply voltage is in a range of about 30 V to about 40 V, more specifically, about 35 V. Therefore, if only the cooling capacity is considered, it is said that it is preferable to generate a voltage difference within a range of 30 V to 40V in the thermoelectric module.

Figure 5:
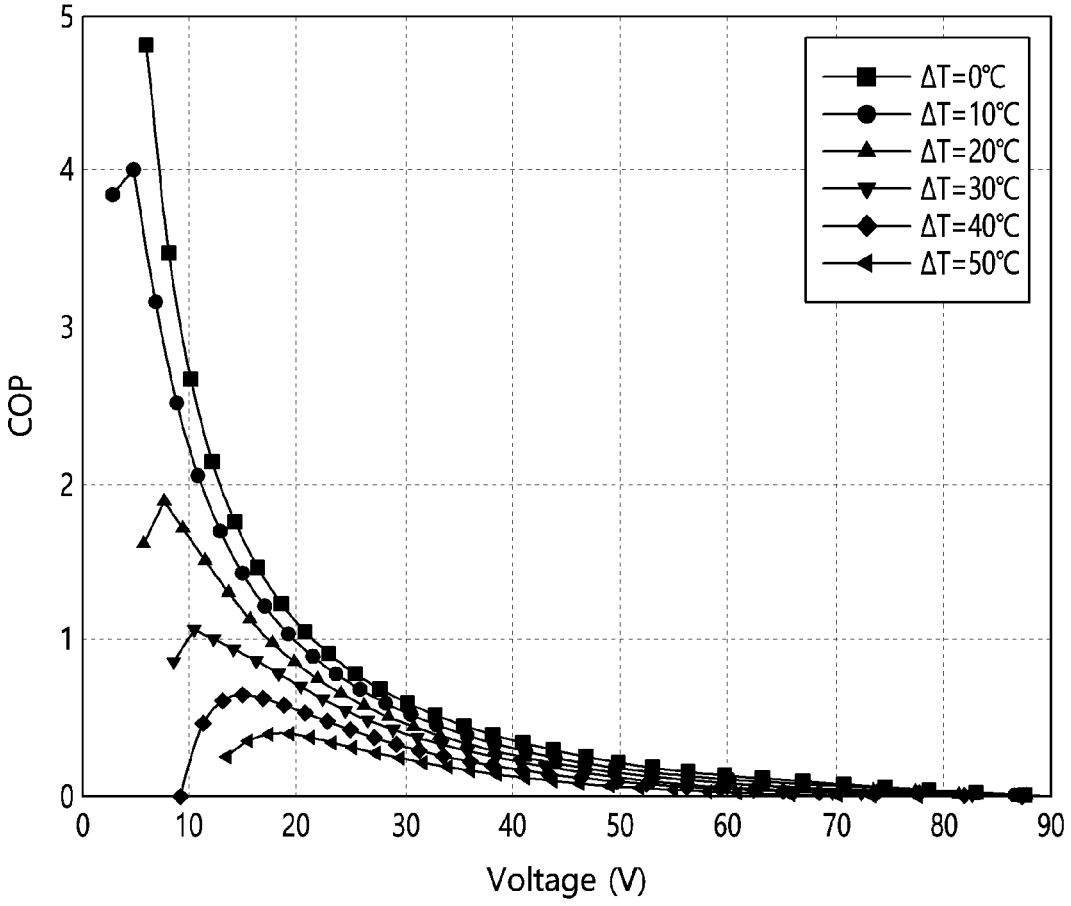
FIG. 5 is a graph illustrating a relationship of efficiency with respect to an input voltage and a Fourier effect.

FIG. 5 is a graph illustrating a relationship of efficiency with respect to the input voltage and the Fourier effect.

Referring to FIG. 5, it is seen that the higher the value ΔT, the lower the efficiency at the same voltage. This will be noted as a natural result because the efficiency is proportional to the cooling capacity.

In addition, when the value ΔT is fixed, for example, when the value ΔT is limited to 30° C. and the change in efficiency according to the change in voltage is observed, the efficiency increases as the supply voltage increases, and the efficiency decreases after a certain time point elapses. This is said to be similar to the graph of the cooling capacity according to the change of the voltage.

Here, the efficiency (COP) is a function of input power as well as cooling capacity, and the input Pe becomes a function of $V^2$ when the resistance of the thermoelectric module 21 is considered as the constant. If the cooling capacity is divided by $V^2$, the efficiency may be expressed as Peltier effect−Peltier effect/$V^2$. Therefore, it is seen that the graph of the efficiency has a shape as illustrated in FIG. 5.

It is seen from the graph of FIG. 5, in which a point at which the efficiency is maximum appears in a region in which the voltage difference (or supply voltage) applied to the thermoelectric module is less than about 20 V. Therefore, when the required value ΔT is determined, it is good to apply an appropriate voltage according to the value to maximize the efficiency. That is, when a temperature of the heat sink and a set temperature of the deep freezing compartment 202 are determined, the value ΔT is determined, and accordingly, an optimal difference of the voltage applied to the thermoelectric module may be determined.

Figure 6:
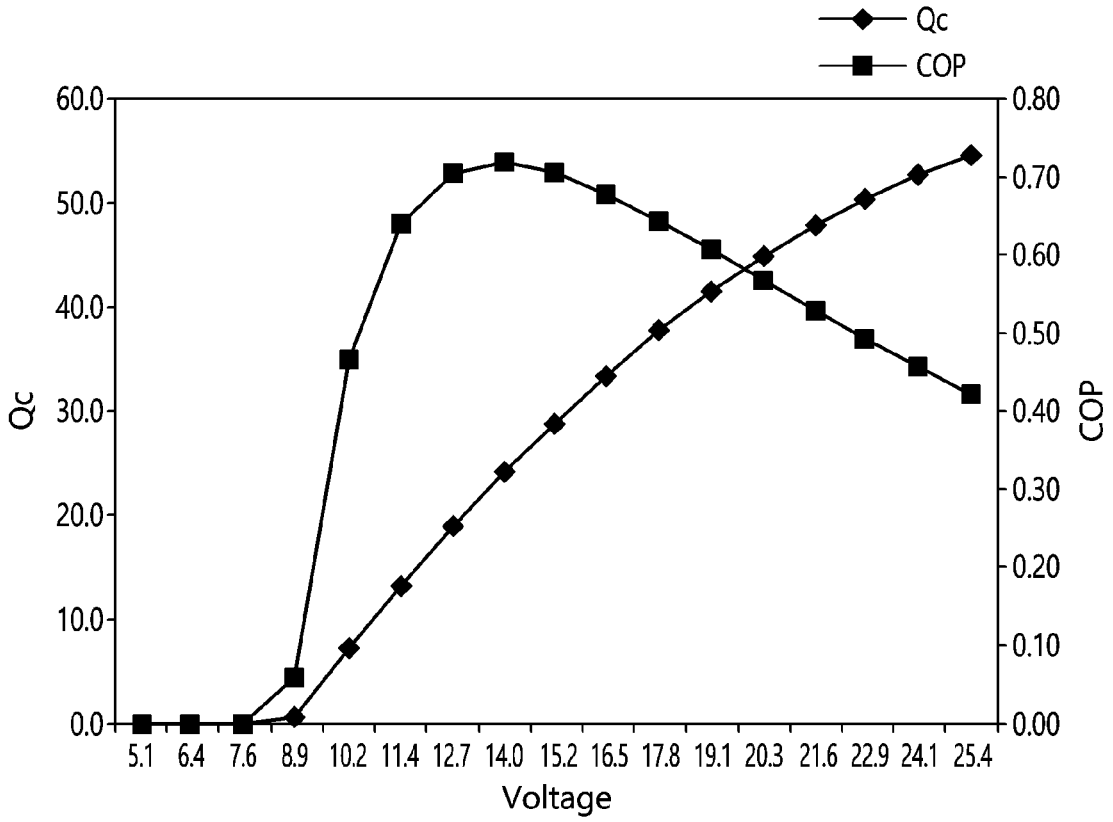
FIG. 6 is a graph illustrating a relationship of cooling capacity and efficiency according to a voltage.

FIG. 6 is a graph illustrating a relationship of the cooling capacity and the efficiency according to a voltage.

Referring to FIG. 6, as described above, as the voltage difference increases, both the cooling capacity and efficiency increase and then decrease.

In detail, it is seen that the voltage value at which the cooling capacity is maximized and the voltage value at which the efficiency is maximized are different from each other. This is seen that the voltage is the first-order function, and the efficiency is the second-order function until the cooling capacity is maximized.

As illustrated in FIG. 6, as an example, in the case of the thermoelectric module having ΔT of 30° C., it is confirmed that the thermoelectric module has the highest efficiency within a range of approximately 12 V to 17 V of the voltage applied to the thermoelectric module. Within the above voltage range, the cooling capacity continues to increase. Therefore, it is seen that a voltage difference of at least 12 V is required in consideration of the cooling capacity, and the efficiency is maximum when the voltage difference is 14 V.

Figure 7:
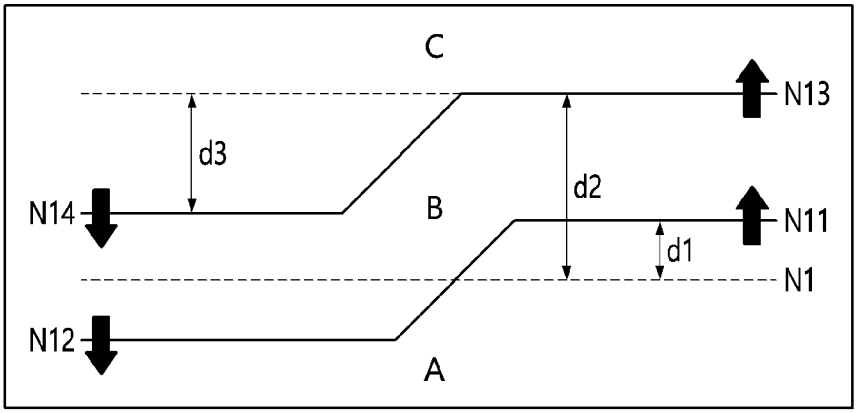
FIG. 7 is a view illustrating a reference temperature line for controlling a refrigerator according to a change in load inside the refrigerator.
Figure 7:
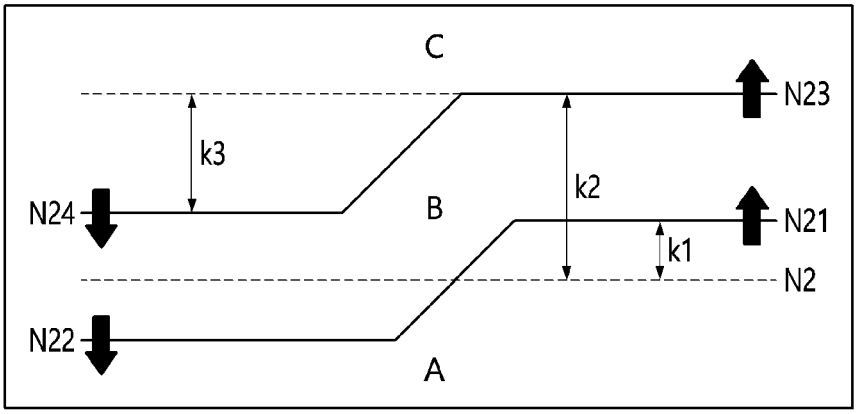
Figure 7:
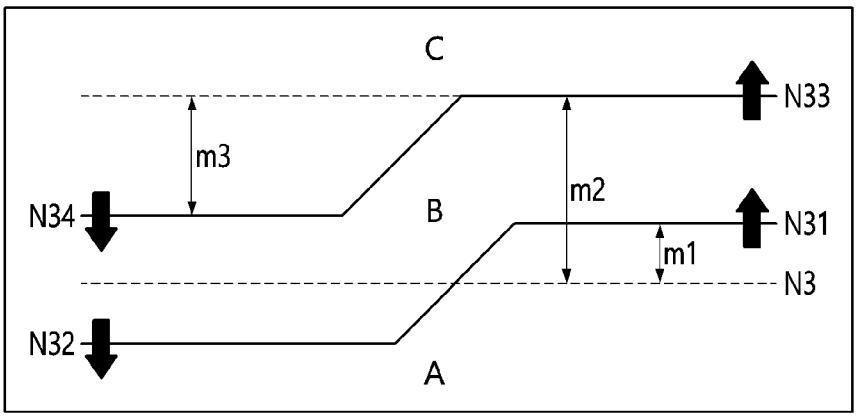

FIG. 7 is a view illustrating a reference temperature line for controlling the refrigerator according to a change in load inside the refrigerator.

Hereinafter, a set temperature of each storage compartment will be described by being defined as a notch temperature. The reference temperature line may be expressed as a critical temperature line.

A lower reference temperature line in the graph is a reference temperature line by which a satisfactory temperature region and a unsatisfactory temperature region are divided. Thus, a region A below the lower reference temperature line may be defined as a satisfactory section or a satisfactory region, and a region B above the lower reference temperature line may be defined as a dissatisfied section or a dissatisfied region.

In addition, an upper reference temperature line is a reference temperature line by which an unsatisfactory temperature region and an upper limit temperature region are divided. Thus, a region C above the upper reference temperature line may be defined as an upper limit region or an upper limit section and may be seen as a special operation region.

When defining the satisfactory/unsatisfactory/upper limit temperature regions for controlling the refrigerator, the lower reference temperature line may be defined as either a case of being included in the satisfactory temperature region or a case of being included in the unsatisfactory temperature region. In addition, the upper reference temperature line may be defined as one of a case of being included in the unsatisfactory temperature region and a case of being included in the upper limit temperature region.

When the internal temperature of the refrigerator is within the satisfactory region A, the compressor is not driven, and when the internal temperature of the refrigerator is in the unsatisfactory region B, the compressor is driven so that the internal temperature of the refrigerator is within the satisfactory region.

In addition, when the internal temperature of the refrigerator is in the upper limit region C, it is considered that food having a high temperature is put into the refrigerator, or the door of the storage compartment is opened to rapidly increase in load within the refrigerator. Thus, a special operation algorithm including a load correspondence operation is performed.

(a) of FIG. 7 is a view illustrating a reference temperature line for controlling the refrigerator according to a change in temperature of the refrigerating compartment.

A notch temperature N1 of the refrigerating compartment is set to a temperature above zero. In order to allow the temperature of the refrigerating compartment to be maintained to the notch temperature N1, when the temperature of the refrigerating compartment rises to a first satisfactory critical temperature N11 higher than the notch temperature N1 by a first temperature difference d1, the compressor is controlled to be driven, and after the compressor is driven, the compressor is controlled to be stopped when the temperature is lowered to a second satisfactory critical temperature N12 lower than the notch temperature N1 by the first temperature difference d1.

The first temperature difference d1 is a temperature value that increases or decreases from the notch temperature N1 of the refrigerating compartment, and the temperature of the refrigerating compartment may be defined as a control differential or a control differential temperature, which defines a temperature section in which the temperature of the refrigerating compartment is considered as being maintained to the notch temperature N1, i.e., approximately 1.5° C.

In addition, when it is determined that the refrigerating compartment temperature rises from the notch temperature N1 to a first unsatisfactory critical temperature N13 which is higher by the second temperature difference d2, the special operation algorithm is controlled to be executed. The second temperature difference d2 may be 4.5° C. The first unsatisfactory critical temperature may be defined as an upper limit input temperature.

After the special driving algorithm is executed, if the internal temperature of the refrigerator is lowered to a second unsatisfactory temperature N14 lower than the first unsatisfactory critical temperature by a third temperature difference d3, the operation of the special driving algorithm is ended. The second unsatisfactory temperature N14 may be lower than the first unsatisfactory temperature N13, and the third temperature difference d3 may be 3.0° C. The second unsatisfactory critical temperature N14 may be defined as an upper limit release temperature.

After the special operation algorithm is completed, the cooling capacity of the compressor is adjusted so that the internal temperature of the refrigerator reaches the second satisfactory critical temperature N12, and then the operation of the compressor is stopped.

(b) of FIG. 7 is a view illustrating a reference temperature line for controlling the refrigerator according to a change in temperature of the freezing compartment.

A reference temperature line for controlling the temperature of the freezing compartment have the same temperature as the reference temperature line for controlling the temperature of the refrigerating compartment, but the notch temperature N2 and temperature variations k1, k2, and k3 increasing or decreasing from the notch temperature N2 are only different from the notch temperature N1 and temperature variations d1, d2, and d3.

The freezing compartment notch temperature N2 may be −18° C. as described above, but is not limited thereto. The control differential temperature k1 defining a temperature section in which the freezing compartment temperature is considered to be maintained to the notch temperature N2 that is the set temperature may be 2° C.

Thus, when the freezing compartment temperature increases to the first satisfactory critical temperature N21, which increases by the first temperature difference k1 from the notch temperature N2, the compressor is driven, and when the freezing compartment temperature is the unsatisfactory critical temperature (upper limit input temperature) N23, which increases by the second temperature difference k2 than the notch temperature N2, the special operation algorithm is performed.

In addition, when the freezing compartment temperature is lowered to the second satisfactory critical temperature N22 lower than the notch temperature N2 by the first temperature difference k1 after the compressor is driven, the driving of the compressor is stopped.

After the special operation algorithm is performed, if the freezing compartment temperature is lowered to the second unsatisfactory critical temperature (upper limit release temperature) N24 lower by the third temperature difference k3 than the first unsatisfactory temperature N23, the special operation algorithm is ended. The temperature of the freezing compartment is lowered to the second satisfactory critical temperature N22 through the control of the compressor cooling capacity.

Even in the state that the deep freezing compartment mode is turned off, it is necessary to intermittently control the temperature of the deep freezing compartment with a certain period to prevent the deep freezing compartment temperature from excessively increasing. Thus, the temperature control of the deep freezing compartment in a state in which the deep freezing compartment mode is turned off follows the temperature reference line for controlling the temperature of the freezing compartment disclosed in (b) FIG. 7.

As described above, the reason why the reference temperature line for controlling the temperature of the freezing compartment is applied in the state in which the deep freezing compartment mode is turned off is because the deep freezing compartment is disposed inside the freezing compartment.

That is, even when the deep freezing compartment mode is turned off, and the deep freezing compartment is not used, the internal temperature of the deep freezing compartment has to be maintained at least at the same level as the freezing compartment temperature to prevent the load of the freezing compartment from increasing.

Therefore, in the state that the deep freezing compartment mode is turned off, the deep freezing compartment notch temperature is set equal to the freezing compartment notch temperature N2, and thus the first and second satisfactory critical temperatures and the first and second unsatisfactory critical temperatures are also set equal to the critical temperatures N21, N22, N23, and N24 for controlling the freezing compartment temperature.

(c) of FIG. 7 is a view illustrating a reference temperature line for controlling the refrigerator according to a change in temperature of the deep freezing compartment in a state in which the deep freezing compartment mode is turned on.

In the state in which the deep freezing compartment mode is turned on, that is, in the state in which the deep freezing compartment is on, the deep freezing compartment notch temperature N3 is set to a temperature significantly lower than the freezing compartment notch temperature N2, i.e., is in a range of about −45° C. to about −55° C., preferably −55° C. In this case, it is said that the deep freezing compartment notch temperature N3 corresponds to a heat absorption surface temperature of the thermoelectric module 21, and the freezing compartment notch temperature N2 corresponds to a heat generation surface temperature of the thermoelectric module 21.

Since the refrigerant passing through the freezing compartment expansion valve 15 passes through the heat sink 24, the temperature of the heat generation surface of the thermoelectric module 21 that is in contact with the heat sink 24 is maintained to a temperature corresponding to the temperature of the refrigerant passing through at least the freezing compartment expansion valve. Therefore, a temperature difference between the heat absorption surface and the heat generation surface of the thermoelectric module, that is, $\Delta T$ is 32° C.

The control differential temperature m1, that is, the deep freezing compartment control differential temperature that defines a temperature section considered to be maintained to the notch temperature N3, which is the set temperature, is set higher than the freezing compartment control differential temperature k1, for example, 3° C.

Therefore, it is said that the set temperature maintenance consideration section defined as a section between the first satisfactory critical temperature N31 and the second satisfactory critical temperature N32 of the deep freezing compartment is wider than the set temperature maintenance consideration section of the freezing compartment.

In addition, when the deep freezing compartment temperature rises to the first unsatisfactory critical temperature N33, which is higher than the notch temperature N3 by the second temperature difference m2, the special operation algorithm is performed, and after the special operation algorithm is performed, when the deep freezing compartment temperature is lowered to the second unsatisfactory critical temperature N34 lower than the first unsatisfactory critical temperature N33 by the third temperature difference m3, the special operation algorithm is ended. The second temperature difference m2 may be 5° C.

Here, the second temperature difference m2 of the deep freezing compartment is set higher than the second temperature difference k2 of the freezing compartment. In other words, an interval between the first unsatisfactory critical temperature N33 and the deep freezing compartment notch temperature N3 for controlling the deep freezing compartment temperature is set larger than that between the first unsatisfactory critical temperature N23 and the freezing compartment notch temperature N2 for controlling the freezing compartment temperature.

This is because the internal space of the deep freezing compartment is narrower than that of the freezing compartment, and the thermal insulation performance of the deep freezing case 201 is excellent, and thus, a small amount of the load input into the deep freezing compartment is discharged to the outside. In addition, since the temperature of the deep freezing compartment is significantly lower than the temperature of the freezing compartment, when a heat load such as food is penetrated into the inside of the deep freezing compartment, reaction sensitivity to the heat load is very high.

For this reason, when the second temperature difference m2 of the deep freezing compartment is set to be the same as the second temperature difference k2 of the freezing compartment, frequency of performance of the special operation algorithm such as a load correspondence operation may be excessively high. Therefore, in order to reduce power consumption by lowering the frequency of performance of the special operation algorithm, it is preferable to set the second temperature difference m2 of the deep freezing compartment to be larger than the second temperature difference k2 of the freezing compartment.

A method for controlling the refrigerator according to an embodiment of the present invention will be described below.

Hereinafter, the content that a specific process is performed when at least one of a plurality of conditions is satisfied should be construed to include the meaning that any one, some, or all of a plurality of conditions have to be satisfied to perform a particular process in addition to the meaning of performing the specific step if any one of the plurality of conditions is satisfied at a time point of determination by the controller.

Figure 8:
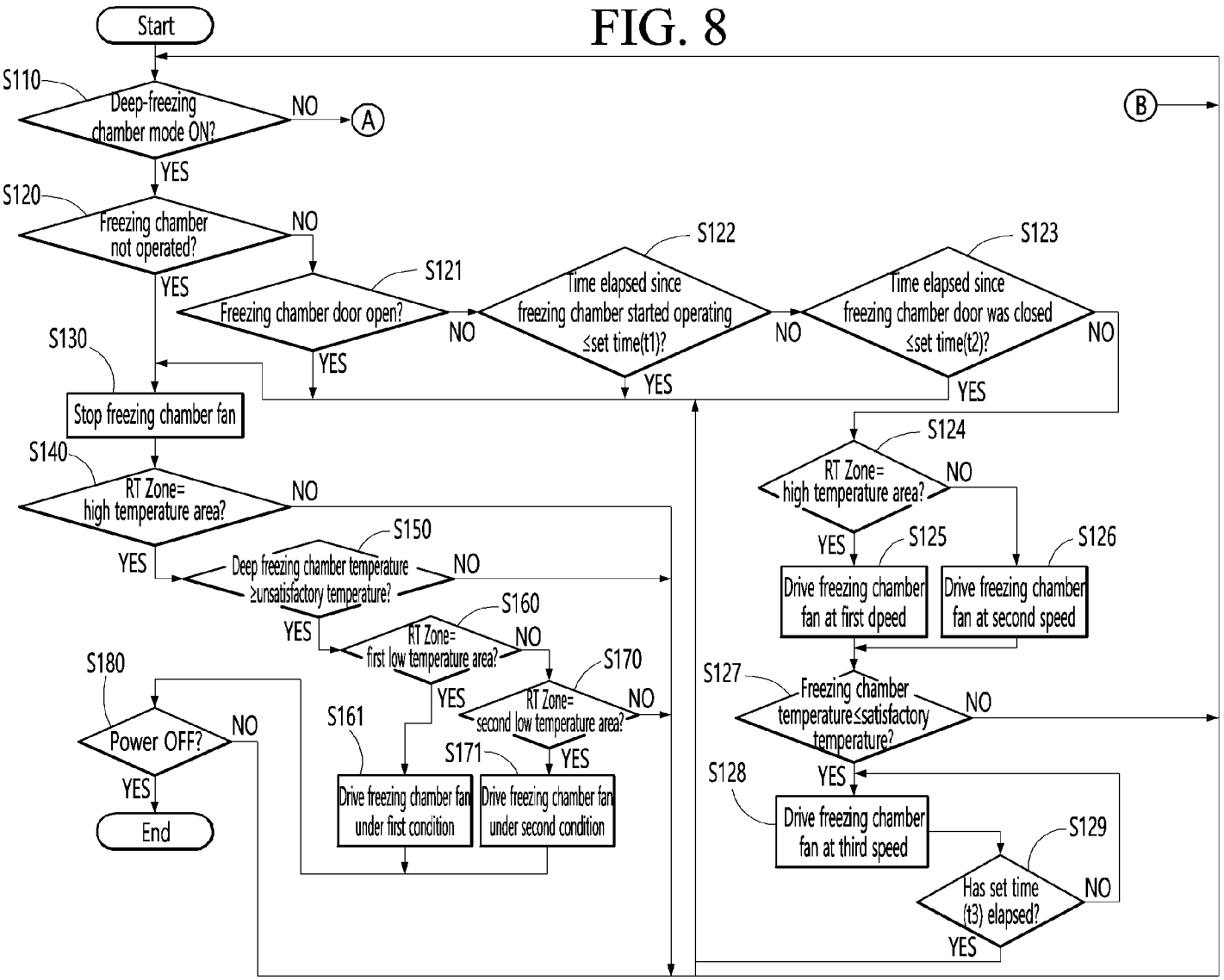
FIGS. 8 and 9 are flowcharts illustrating a method for controlling a refrigerator according to an embodiment of the present invention.
Figure 9:
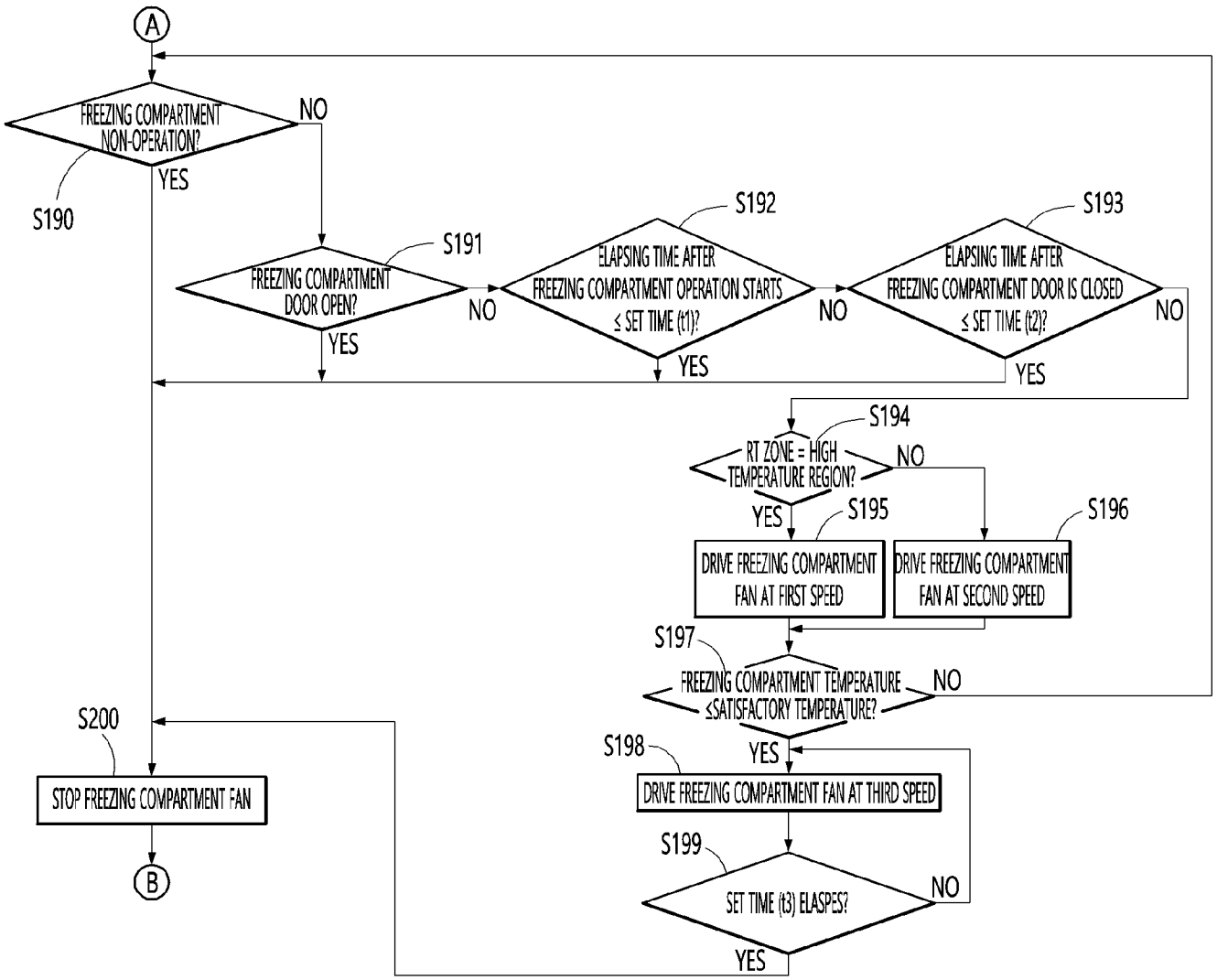

FIGS. 8 and 9 are flowcharts illustrating a method for controlling the refrigerator according to an embodiment of the present invention.

In detail, the flowchart disclosed in FIG. 8 illustrates a control method for controlling an output of the freezing compartment fan in a state in which the deep freezing compartment mode is turned on, and the flowchart disclosed in FIG. 9 illustrates a control method for controlling the output of the freezing compartment fan in a state in which the deep freezing compartment mode is turned off.

When the deep freezing compartment mode is turned on, a user presses a deep freezing compartment mode execution button to indicate that the deep freezing compartment mode is in a state capable of being performed. Thus, in the state in which the deep freezing compartment mode is turned on, power may be immediately applied to the thermoelectric module when the specific condition is satisfied.

Conversely, a state in which the deep freezing compartment mode is turned off means a state in which power supply to the thermoelectric module is cut off. Thus, power is not supplied to the thermoelectric module and the deep freezing compartment fan except for exceptional cases.

First, referring to FIG. 8, the controller determines whether the current state is the deep freezing compartment mode on state (S110). If it is determined that the current deep freezing compartment mode is in the off state, the process proceeds to a process A, which will be described in detail with reference to FIG. 9.

In detail, if it is determined that the current deep freezing compartment mode is in the on state, the controller determines whether the current freezing compartment is in a non-operational state (S120).

The operation of the freezing compartment may not be performed because the freezing compartment is in a satisfactory temperature region A illustrated in (b) of FIG. 7, and even if it is not in the satisfactory temperature region A, the operation of the freezing compartment may not be performed due to other reasons including a refrigerating compartment exclusive operation mode.

Thus, the process (S120) means that it is determined whether the current freezing compartment is in the non-operational state regardless of whether the freezing compartment is in the satisfactory temperature region A.

If the freezing compartment is in the non-operational state, the freezing compartment fan 171 is stopped (S130). Here, the stopping of the freezing compartment fan 171 includes not only stopping of the freezing compartment fan 171 while driving, but also maintaining of the freezing compartment fan 171 that is in the stopped state.

Sequentially, the controller detects the internal temperature of the freezing compartment to determines whether an operation for preventing sagging of cold air in the freezing compartment is performed. That is, the controller determines whether the freezing compartment temperature is in the satisfactory temperature region (S140), and determines whether the cold air sagging prevention operation is performed.

On the other hand, if it is determined that the freezing compartment is currently operating, at least one or more of a process of determining whether the freezing compartment door is opened (S121), a process of determining whether an elapsing time after the freezing compartment process starts is within an actual time t1 (S122), and a process of determining whether an elapsing time after the freezing compartment door is closed is within a set time t2 are performed.

The set time t1 may be 90 seconds, but is not limited thereto, and the set time t2 may be 20 seconds, but is not limited thereto.

Here, when it is determined that the current deep freezing compartment mode is turned on, it is summarized as controlling the refrigerator through the controller to proceed to the state in which the freezing compartment fan is stopped, or the stopping of the freezing compartment fan is maintained when at least one of the determination processes of the processes (S120, S121, S122, and S123) is satisfied (S130). It is natural that it should be interpreted as including a case in which all of the conditions of the processes (S120, S121, S122, and S123) are satisfied.

In the case of performing a plurality of processes among the processes (S121 to S123), the plurality of processes are sequentially performed, but there is no limitation in the order of the execution.

When the conditions determined in the processes (S120, S121, S122, and S123) are not all satisfied, the process proceeds to the process (S124) of determining the room temperature.

In detail, the controller may store a lookup table divided into a plurality of room temperature zones (RT zones) according to a range of the room temperature. As an example, as shown in Table 1 below, it may be subdivided into eight room temperature zones (RT zones) according to the range of the room temperature. However, the present invention is not limited thereto.

TABLE 1

| High temperature zone | | Medium temperature zone | | | Low temperature zone | | |
|---|---|---|---|---|---|---|---|
| RT Zone 1 | RT Zone 2 | RT Zone 3 | RT Zone 4 | RT Zone 5 | RT Zone 6 | RT Zone 7 | RT Zone 8 |
| T ≥ 38° C. | 34° C. ≤ T < 38° C. | 27° C. ≤ T < 34° C. | 22° C. ≤ T < 27° C. | 18 ≤ T < 22° C. | 12° C. ≤ T < 18° C. | 8° C. ≤ T < 12° C. | T < 8° C. |

In more detail, a zone of the temperature range with the highest room temperature may be defined as an RT zone 1 (or Z1), and a zone of the temperature range with the lowest room temperature may be defined as an RT zone 8 (or Z8). Here, Z1 may be mainly seen as the indoor state in midsummer, and Z8 may be seen as an indoor state in the middle of winter.

Furthermore, the room temperature zones may be grouped into a large category, a medium category, and a small category. For example, as shown in Table 1, the room temperature zone may be defined as a low temperature zone, a medium temperature zone (or a comfortable zone), and a high temperature zone according to the temperature range.

In operation S124, the controller determines that the current state is in any zone based on the room temperature at which the refrigerator is installed. For example, it may be determined whether the zone (RT zone) in which the current room temperature belongs is in a high temperature zone. If it is determined that the temperature zone (RT zone) in which the current room temperature belongs is in the high temperature zone, the freezing compartment fan may be driven at a first speed (S125).

If it is determined that the current room temperature zone does not belong to the high temperature zone, the freezing compartment fan may be driven at a second speed (S126). The second speed may be slower than the first speed.

While the freezing compartment fan is driven at the first or second speed, the controller determines whether the freezing compartment temperature enters the satisfactory temperature region A illustrated in (b) of FIG. 7B (S127).

If it is determined that the freezing compartment temperature does not enter the satisfactory temperature region A, the process returns to the process (S110) of determining whether the deep freezing compartment mode is turned on.

On the other hand, if it is determined that the freezing compartment temperature enters the satisfactory temperature region A, the freezing compartment fan is driven at a third speed for a set time t3 (S128 and S129). The third speed may be slower than the second speed. In detail, the first speed may be set to a high speed, the second speed may be set to a medium speed, and the third speed may be set to a low speed.

When the set time t3 elapses, the freezing compartment fan is stopped (S130), and the process proceeds to a process of determining whether to perform the cold air sagging prevention operation (S140 or below). The process (S140) may be a freezing compartment temperature determination process for determining whether the cold air sagging prevention operation is performed in the temperature range in which the freezing compartment temperature is satisfied.

That is, since the freezing compartment temperature is in an unsatisfactory state even when the freezing compartment is not in operation, it is necessary to determine whether the freezing compartment temperature is within the satisfactory temperature range. For example, when it conflicts with another type of operation mode such as an exclusive operation of the refrigerating compartment, the priority of mode execution drops, and thus the operation during the freezing is not performed even though the temperature of the freezing compartment is not in the satisfactory temperature range may not be performed.

On the other hand, if it is determined that the freezing compartment temperature is not within the satisfactory temperature range, the process returns to the process (S110) of determining whether the deep freezing compartment mode is turned on. For example, if it is determined that the freezing compartment temperature does not enter the satisfactory temperature range while the freezing compartment fan rotates at any one speed of the high speed, the medium speed, and the low speed, the process returns to the process (S110) of determining whether the deep freezing compartment mode is turned on to repeatedly determine whether the freezing compartment fan is stopped or continuously rotates.

Here, when it is determined that the freezing compartment temperature does not enter the satisfactory temperature range, it is also possible to control to return to any one of the processes (S120, S121, S122, S123, and S124) in addition to the method of returning to the process (S110).

On the other hand, if it is determined that the current freezing compartment temperature is within the satisfactory temperature range, the first condition for performing the cold air sagging prevention operation may be referred to as a satisfactory state.

A process of determining whether the deep freezing compartment temperature, which corresponds to the second condition, is equal to or greater than the unsatisfactory temperature is performed (S150). That is, the process of determining whether the deep freezing compartment temperature is above the unsatisfactory temperature, that is, in the regions B and A illustrated in (b) of FIG. 7 is performed. This is seen as a condition that the controlling of the freezing compartment fan for preventing the cold air sagging according to the present invention is performed under the condition that the deep freezing compartment cooling operation is being performed in the unsatisfactory temperature region of the deep freezing compartment.

It is determined whether the current room temperature, which corresponds to the third condition, belongs to the low temperature region (S160).

In detail, in this process, it is determined whether the current room temperature is equal to or less than the upper limit temperature of the first low temperature region.

A case in which the current room temperature is lower than the maximum temperature of the first low temperature region, and thus, the room temperature zone (RT zone) to which the current temperature belongs is Z7 or more means that a temperature difference between a temperature within the refrigerator and a temperature of the indoor space is relatively low due to the very low room temperature, and thus, a loss of cold air is not large. As a result, the period for driving the freezing compartment fan is relatively long, and a driving time is controlled to be short.

The long operation period of the freezing compartment fan means that it takes a long time to restart the freezing compartment fan after stopping the operation. Therefore, since the compressor circulates the refrigerant by operating at the maximum cooling capacity for cooling the deep freezing compartment while the freezing compartment fan is stopped, there is a high possibility that cold air inside the freezing evaporation compartment in which the freezing compartment evaporator is accommodated is introduced into the floor of the freezing compartment.

In this situation, the freezing compartment fan is controlled to operate under the first condition (S161).

On the other hand, when it is determined that the room temperature zone (RT zone) to which the current room temperature belongs does not correspond to the first low temperature region, that is, whether the room temperature zone belongs to the second low temperature region higher than the temperature of the first low temperature region is determined.

In detail, when it is determined that the room temperature zone (RZ zone) to which the current room temperature belongs corresponds to the second low temperature region, the freezing compartment fan is controlled to be driven under the second condition (S171).

Here, the second low temperature region may include, but is not limited to, the room temperature zone (RT zone) 6 in the table above and may also include the room temperature zone (RT zone) 5 corresponding to the middle temperature region.

The first condition and the second condition for driving the freezing compartment fan are defined as a ratio of a driving time and a stopping time of the freezing compartment fan. The freezing compartment fan stopping time under the first condition may be set longer than the freezing compartment fan stopping time under the second condition.

For example, in the first condition, a ratio of the stopping time (off time) of the freezing compartment fan to the driving time (on time) of the freezing compartment fan may be 3 or more. More specifically, in the first condition, the freezing compartment fan may be controlled to repeatedly perform an operation of maintaining the stopped state for 225 seconds after being driven for 75 seconds. Here, it should be noted that the ratio of the stopping time to the driving time of the freezing compartment fan is not limited to the conditions presented above.

In addition, in the second condition, a ratio of the freezing time of the freezing compartment fan to the driving time of the freezing compartment fan may be 5 or more. More specifically, in the second condition, the freezing compartment fan may be controlled to repeatedly perform an operation of maintaining the stopped state for 375 seconds after being driven for 75 seconds.

Here, the reason of the design in which the lower the room temperature, the longer the off time of the freezing compartment fan is as follows.

In detail, the lower the room temperature, the more severe the cold air sagging due to the cold air that is reversely penetrated from the freezing evaporation compartment to the freezing compartment. In order to solve this problem, if the on/off ratio of the fan is taken short, it may cause supercooling of the freezing compartment.

In other words, if the off time of the freezing compartment fan is shortened because the cold air sagging phenomenon becomes severe, the freezing compartment supercooling phenomenon may be caused by relatively frequent cold air circulation in the freezing compartment.

Therefore, in order to solve the problem of the sagging of the cold air and simultaneously prevent the supercooling of the freezing compartment, it is better to set the off time of the freezing compartment fan to be longer as the room temperature is lower.

Under the first and second conditions, the freezing compartment fan may be controlled to be constantly maintained at a specific speed, for example, may be controlled to be driven at a low speed, but is not limited thereto.

Under the first and second conditions, the freezing compartment fan may periodically rotate at a low speed (or at another speed) to minimize the phenomenon that cold air in the freezing compartment sags to the bottom of the freezing compartment to causes temperature non-uniformity in the freezing compartment.

In addition, while the freezing compartment fan is repeatedly driven and stopped under any one of the first and second conditions at the set speed, the controller determines whether the refrigerator is powered off (S180), and when the state in which the power is turned on is maintained, the process returns to the process (S110) of determining whether the deep freezing compartment mode is turned on.

Hereinafter, the control of the freezing compartment fan when the deep freezing compartment mode is in the off state will be described.

FIG. 9 is a flowchart illustrating a method for controlling a freezing compartment fan when the deep freezing compartment mode is turned off. When it is determined that the deep freezing compartment mode is not in the deep freezing compartment mode of FIG. 8 to proceed to the process B, the algorithm operation according to the flowchart of FIG. 9 is performed.

In detail, when the deep freezing compartment mode is turned off, at least one or more processes of a process (S190) of determining whether the freezing compartment is in a non-operational state, a process (S191) of determining whether the freezing compartment door is opened, and a process (S192) of determining whether the elapsing time elapses above the set time t1 after the freezing compartment starts, and a process (S192) of determining whether the elapsing time elapses above the set time t2 after the freezing compartment door is closed will be performed.

If at least one or all of the case in which the freezing compartment is not in operation, the case in which the door of the freezing compartment is opened, and the case in which the elapsing time does not reach the set time t1 after the freezing compartment operation starts, or the case the elapsing time does not reach the set time t2 after the door of the freezing compartment is closed is/are satisfied, the freezing compartment fan is controlled to be stopped (S200). This may be said to be substantially the same as the process of performing the processes (S120 to S123) of FIG. 8.

As described in FIG. 8, the execution order of the processes (S190 to S193) is not limited to the order presented in the flowchart.

On the other hand, if all of the conditions of the processes (S190 to S193) are not satisfied, the process (S194) of detecting the room temperature and determining a zone on which the detected room temperature exists is performed. Here, it is not excluded that all of the processes (S190 to S194) are omitted, and the process proceeds to the process (S194) of directly detecting the room temperature.

When it is determined that the detected room temperature belongs to the high temperature region, the freezing compartment fan may be controlled to be driven at a first speed. If it is determined that the detected room temperature does not belong to the high temperature region, the freezing compartment fan is controlled to drive at a second speed.

In addition, whether the freezing compartment temperature enters the satisfactory temperature region A illustrated in (b) of FIG. 7 is determined, and when it is determined that the freezing compartment temperature does not enter the satisfactory temperature range, the process returns to the process (S190) of determining whether the freezing compartment is not in operation.

Here, when it is determined that the freezing compartment temperature does not enter the satisfactory temperature region A, it is also possible to control to return to any one of the processes (S191, S192, S193, and S194). Alternatively, if the freezing compartment temperature does not reach the satisfactory temperature (S199), it is also possible to control to return to the process (S110) of determining whether the deep freezing compartment mode is turned on.

On the other hand, if it is determined that the freezing compartment temperature enters the satisfactory temperature range, the freezing compartment fan is controlled to be driven at a third speed for a set time t3 (S198 and S199). When the set time t3 elapses, the freezing compartment fan is stopped (S200), and the process returns to the process (S110) of determining whether the deep freezing compartment mode is turned on.

The control method from the processes (S194 to S200) of FIG. 9 is substantially the same as the control method from the processes (S124 to S130) of FIG. 8. However, if the deep freezing compartment mode is not turned on, it will be different from the case in which the deep freezing compartment mode is turned on to proceed to the process (S110) of determining whether the deep freezing compartment mode is turned on after the freezing compartment fan is stopped.

That is, when the deep freezing compartment mode is in the on state, it is different from proceeding to the process (S140 or below) of determining whether the cold air sagging operation is performed.

The first to third speeds may be considered the same as the first to third speeds described with reference to FIG. 8.

The invention claimed is:

1. A refrigerator comprising:

a refrigerating compartment;

a freezing compartment that is partitioned from the refrigerating compartment;

a deep freezing compartment accommodated in the freezing compartment and partitioned from the freezing compartment, a temperature of the deep freezing compartment being lower than a temperature of the freezing compartment;

a thermoelectric module to cool the deep freezing compartment to a temperature less than that of the freezing compartment;

a refrigerating compartment evaporator to cool the refrigerating compartment;

a heat sink connected in parallel to the refrigerating compartment evaporator and in which refrigerant flows;

a freezing compartment evaporator in parallel to the refrigerating compartment evaporator and connected in series with the heat sink to a discharge side of the heat sink such that refrigerant passing through the heat sink flows into the freezing compartment evaporator;

a freezing compartment fan to blow air within the freezing compartment to forcibly flow; and a controller configured to:

determine a temperature within the deep freezing compartment, determine a temperature within the freezing compartment, control driving of the freezing compartment fan, and wherein the thermoelectric module includes:

a thermoelectric element having a heat absorption surface and a heat dissipation surface;

a cold sink connected to the heat absorption surface and exposed to the deep freezing compartment;

a deep freezing compartment fan provided in front of the cold sink to circulate cold air inside the deep freezing compartment, wherein the heat sink is in contact with the heat dissipation surface of the thermoelectric element, wherein the controller is configured to perform a cold air sagging prevention operation in which the freezing compartment fan is repeatedly driven and stopped in response to two conditions being met:

(i) the temperature of the freezing compartment is in a satisfactory temperature range and thereby the freezing compartment fan is stopped; and (ii) a deep freezing compartment cooling operation is performed in an unsatisfactory temperature region of the deep freezing compartment.

2. The refrigerator according to claim 1, wherein the cold air sagging prevention operation comprises the controller configured to set a stopping time of the freezing compartment fan to be longer than a driving time of the freezing compartment fan.

3. The refrigerator according to claim 1, wherein, in the state in which the deep freezing compartment mode is turned on, when the controller determines that at least one of below is satisfied:

a state in which an operation of the freezing compartment is not performed, a state in which a freezing compartment door is opened, a case in which an elapsing time after the operation of the freezing compartment starts is within a first set time, or a case in which an elapsing time after the freezing compartment door is closed is within a second set time, the controller is configured to stop or maintain a stopped state of the freezing compartment fan.

4. The refrigerator according to claim 1, wherein, in the state in which the deep freezing compartment mode is turned off, when the controller determines that at least one of below is satisfied:

a state in which an operation of the freezing compartment is not performed, a state in which a freezing compartment door is opened, a case in which an elapsing time after the operation of the freezing compartment starts is within a first set time, or a case in which an elapsing time after the freezing compartment door is closed is within a second set time, the controller is configured to stop or maintain a stopped state of the freezing compartment fan.

5. The refrigerator according to claim 2, wherein the cold air sagging prevention operation comprises the controller configured to set a ratio of the driving time and the stopping time of the freezing compartment fan differently according to room temperature, the room temperature being a temperature of a space at which the refrigerator is installed.

6. The refrigerator according to claim 5, wherein the higher the room temperature, the shorter the stopping time of the freezing compartment fan is set.

7. The refrigerator according to claim 3, wherein, in the state in which the deep freezing compartment mode is turned on, when the controller determines that a second set time has elapsed after a freezing compartment door is closed, and a first set time has elapsed after an operation of the freezing compartment starts, the controller is configured to drive the freezing compartment fan, and a driving speed of the freezing compartment fan is set differently according to room temperature, the room temperature being a temperature of a space at which the refrigerator is installed.

8. The refrigerator according to claim 7, wherein, when the room temperature is determined to be in a high temperature region, among a low speed, a medium speed and a high speed of the freezing compartment fan, the speed of the freezing compartment fan is set to the high speed, and when the room temperature is determined not to be in the high temperature region, the speed of the freezing compartment fan is set to the medium speed.

9. The refrigerator according to claim 8, wherein, while the freezing compartment fan rotates at the high or medium speed, when the controller determines that the temperature of the freezing compartment has entered a satisfactory temperature region, the speed is changed at the low speed and is stopped after being further driven for a third set time.

10. The refrigerator according to claim 4, wherein, in the state in which the deep freezing compartment mode is turned off, when the controller determines that a second set time has elapsed after a freezing compartment door is closed, and a first set time has elapsed after an operation of the freezing compartment starts, the controller is configured to drive the freezing compartment fan, and a driving speed of the freezing compartment fan is set differently according to room temperature, the room temperature being a temperature of a space at which the refrigerator is installed.

11. The refrigerator according to claim 10, wherein, when the room temperature is determined to be in a high temperature region, among a low speed, a medium speed and a high speed of the freezing compartment fan, the speed of the freezing compartment fan is set to the high speed, and when the room temperature is determined not to be in the high temperature region, the speed of the freezing compartment fan is set to the medium speed.

12. The refrigerator according to claim 11, wherein, while the freezing compartment fan rotates at the high or medium speed, when the controller determines that the temperature of the freezing compartment has entered a satisfactory temperature region, the speed is changed to the low speed and is stopped after being further driven for a third set time.

13. A method for controlling a refrigerator by a controller, comprising:

determining a temperature within a deep freezing compartment;

determining a temperature within a freezing compartment, the temperature within the deep freezing compartment being lower than the temperature within the freezing compartment; and when the temperature of the freezing compartment is in a satisfactory temperature range, and a deep freezing compartment mode is turned on to perform a deep freezing compartment cooling operation, performing a cold air sagging prevention operation in which a freezing compartment fan is repeatedly driven and stopped in response to two conditions being met:

(i) the temperature of the freezing compartment is in a satisfactory temperature range and thereby the freezing compartment fan is stopped; and (ii) a deep freezing compartment cooling operation is performed in an unsatisfactory temperature region of the deep freezing compartment, wherein the controller is configured to set a ratio of a driving time and a stopping time of the freezing compartment fan differently according to room temperature, the room temperature being a temperature of a space at which the refrigerator is installed.

14. The method according to claim 13, wherein the cold air sagging prevention operation comprises setting the stopping time of the freezing compartment fan to be longer than the driving time of the freezing compartment fan.

15. The method according to claim 13, wherein, in the state in which the deep freezing compartment mode is turned on, when it is determined that at least one of below is satisfied:

a state in which an operation of the freezing compartment is not performed, a state in which a freezing compartment door is opened, a case in which an elapsing time after the operation of the freezing compartment starts is within a first set time, or a case in which an elapsing time after the freezing compartment door is closed is within a second set time, stopping or maintaining a stopped state of the freezing compartment fan.

16. The method according to claim 13, wherein, in the state in which the deep freezing compartment mode is turned off, when it is determined that at least one of below is satisfied:

a state in which an operation of the freezing compartment is not performed, a state in which a freezing compartment door is opened, a case in which an elapsing time after the operation of the freezing compartment starts is within a first set time, or a case in which an elapsing time after the freezing compartment door is closed is within a second set time, stopping or maintaining a stopped state of the freezing compartment fan.

17. The method according to claim 15, wherein, in the state in which the deep freezing compartment mode is turned on, when it is determined that a second set time has elapsed after a freezing compartment door is closed, and a first set time has elapsed after an operation of the freezing compartment starts, driving the freezing compartment fan, and setting a driving speed of the freezing compartment fan differently according to the room temperature.

18. The method according to claim 17, wherein, among a low speed, a medium speed and a high speed of the freezing compartment fan, while the freezing compartment fan rotates at the high or medium speed, when it is determined that the temperature of the freezing compartment has entered a satisfactory temperature region, changing the speed to the low speed and stopping the freezing compartment fan after being further driven for a third set time.

19. The method according to claim 16, wherein, in the state in which the deep freezing compartment mode is turned off, when it is determined that a second set time has elapsed after a freezing compartment door is closed, and a first set time has elapsed after an operation of the freezing compartment starts, driving the freezing compartment fan, and setting a driving speed of the freezing compartment fan differently according to the room temperature.

20. The method according to claim 19, wherein, among a low speed, a medium speed and a high speed of the freezing compartment fan, while the freezing compartment fan rotates at the high or medium speed, when it is determined that the temperature of the freezing compartment has entered a satisfactory temperature region, changing the speed to the low speed and stopping the freezing compartment fan after being further driven for a third set time.

* * * * *